US008662614B2

(12) United States Patent
Arakane

(10) Patent No.: US 8,662,614 B2
(45) Date of Patent: Mar. 4, 2014

(54) LIQUID EJECTION APPARATUS

(75) Inventor: Satoru Arakane, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 245 days.

(21) Appl. No.: 13/349,512

(22) Filed: Jan. 12, 2012

(65) Prior Publication Data

US 2012/0223987 A1 Sep. 6, 2012

(30) Foreign Application Priority Data

Mar. 3, 2011 (JP) ..... 2011-046773

(51) Int. Cl.
*B41J 29/38* (2006.01)

(52) U.S. Cl.
USPC ..... 347/12

(58) Field of Classification Search
None
See application file for complete search history.

(56) References Cited

U.S. PATENT DOCUMENTS 8,434,848 B2 * 5/2013 Sakakibara et al. ..... 347/16

FOREIGN PATENT DOCUMENTS

| | | | | |
|---|---|---|---|---|
| JP | 2000-355101 A | | 12/2000 | |
| JP | 2004-050705 A | | 2/2004 | |
| JP | 2004-106497 A | | 4/2004 | |
| JP | 2005-335192 A | | 12/2005 | |
| JP | 2005335192 A | * | 12/2005 | ..... B41J 2/01 |
| JP | 2010-173215 A | | 8/2010 | |

* cited by examiner

*Primary Examiner* — Geoffrey Mruk
*Assistant Examiner* — Bradley Thies
(74) *Attorney, Agent, or Firm* — Baker Botts L.L.P.

(57) ABSTRACT

A liquid ejection apparatus including a first-recording executing section configured to execute a two-way processing based on first data included in recording data corresponding to a predetermined maximum number of lines recordable during a single movement of a carriage, the first data being data based on which liquid ejection is performed on a downstream side of a unit area in which a ratio of the number of dots each required for multi-color ejection to the number of all dots is not less than a first value. The first-recording executing section executes a one-way processing based on data corresponding to the unit area in which the ratio is not less than the first value and data based on which liquid ejection is performed on an upstream side of the unit area, which two data are included in the recording data corresponding to the predetermined maximum number.

9 Claims, 13 Drawing Sheets

LIQUID EJECTION APPARATUS

CROSS REFERENCE TO RELATED APPLICATION

The present application claims priority from Japanese Patent Application No. 2011-046773, which was filed on Mar. 3, 2011, the disclosure of which is herein incorporated by reference in its entirety.

BACKGROUND OF THE INVENTION

1. Field of the Invention

The present invention relates to a liquid ejection apparatus configured to eject a liquid droplet(s) onto a recording medium to perform image recording.

2. Description of the Related Art

There is conventionally known an ink-jet recording apparatus configured to eject liquid droplets onto a recording medium to perform image recording. The image recording by the ink-jet recording apparatus is performed by ejection of ink droplets as one example of the liquid droplets from nozzles.

The image recording on the recording medium by the ink-jet recording apparatus is performed in the following manner. That is, a recording portion having a nozzle face in which the nozzles are formed ejects the ink droplets from the nozzles onto the recording medium while moving in scanning directions intersecting a conveyance direction in which the recording medium is conveyed.

Here, in a case where the ink-jet recording apparatus is capable of recording a color image on the recording medium, inks of a plurality of types (colors) are supplied to the nozzles. Specifically, the nozzles include nozzles to which cyan ink (C) is supplied, nozzles to which magenta ink (M) is supplied, nozzles to which yellow ink (Y) is supplied, and nozzles to which black ink (Bk) is supplied. The nozzles of four types are arranged in the nozzle face in a predetermined order. In the ink jet recording apparatus, the recording portion ejects at least one of the inks of four colors onto the same position on the recording medium while moving. As a result, various colors can be recorded on the recording medium.

However, order of the ejection of the inks where the recording portion ejects the inks of a plurality of the colors onto the same position on the recording medium while moving in one of the scanning directions is reverse to order of the ejection of the inks where the recording portion ejects the inks of a plurality of the colors onto the same position on the recording medium while moving in the other of the scanning directions. For example, where the order of the ejection of the inks onto the same position on the recording medium while the recording portion is moved in one of the scanning directions is cyan, magenta, and yellow, the order of the ejection of the inks onto the same position on the recording medium while the recording portion is moved in the other of the scanning directions is yellow, magenta, and cyan. In the case where the orders of the ejection of the inks are different from each other, even if the ink of the same color is ejected in the same amount, a color difference of the recorded image on the recording medium may unadvantageously occur.

In order to solve such a problem, there is known a conventional ink-jet recording apparatus configured such that an area on which a dot is formed by inks of different colors is defined as an overlapping-dot recording area. In this ink-jet recording apparatus, for a recording area containing at least the overlapping-dot recording area, a one-way recording operation is performed in which a recording portion performs image recording by ejecting the inks while moving in one direction of the scanning directions (i.e., in a direction from one end to the other end of a scanning area of the recording portion). For the other recording areas, a two-way recording operation is performed in which the recording portion performs image recording by ejecting the inks while moving in the one direction and the other direction of the scanning directions (the other direction is a direction from the other end to the one end of the scanning area of the recording portion).

SUMMARY OF THE INVENTION

However, in the conventional ink-jet recording apparatus, the more overlapping-dot recording areas (e.g., recording areas onto which the inks of colors other than black are to be ejected) in the recording medium, the more frequently the one-way recording operation is performed. In the ink-jet recording apparatus, where the one-way recording operation is to be performed in a state in which the recording portion is located at the other end of the scanning area, the recording portion needs to be moved from the other end to the one end of the scanning area before the one-way recording operation is performed. This movement increases a time required for the image recording on the recording medium by the recording portion. The time increased by the movement increases with the larger number of the overlapping-dot recording areas on the recording medium.

This invention has been developed in view of the above-described situations, and it is an object of the present invention to provide a liquid ejection apparatus configured to record an image on a recording medium without lowering of a recording speed while preventing an occurrence of a color difference of an image recorded on the recording medium due to a difference of liquid ejection order.

The object indicated above may be achieved according to the present invention which provides a liquid ejection apparatus comprising: a conveying mechanism configured to convey a recording medium in a first direction along a conveying path; a carriage disposed above the conveying mechanism so as to be reciprocable in a second direction and a third direction, the second direction being a direction perpendicular to the first direction and along an image recording face of the recording medium, the third direction being a direction opposite to the second direction; a recording head mounted on the carriage and having a nozzle face in which a plurality of nozzles are formed, the recording head being configured to eject liquid droplets of a single color or a plurality of colors from the plurality of nozzles toward the conveying path to record an image, the plurality of nozzles being divided into a plurality of nozzle groups in each of which a predetermined number of the plurality of nozzles are arranged in the first direction, the plurality of nozzle groups being arranged in the second direction, the recording head being configured to eject the liquid droplets of each of the plurality of colors from a corresponding one of the plurality of nozzle groups; and a controller configured to selectively execute (i) a one-way recording processing in which, while controlling the carriage to move in the second direction in a state in which the conveyance of the recording medium by the conveying mechanism is stopped, the controller controls the recording head to eject the liquid droplets from the plurality of nozzle groups on the basis of recording data to form at least one line, and, while controlling the carriage to move in the third direction in the state in which the conveyance of the recording medium is stopped, the controller controls the recording head not to eject the liquid droplets from the plurality of nozzle groups and (ii) a two-way recording processing in which, while controlling the carriage to move in the second direction and the third direction in the state in which the conveyance of the recording medium is stopped, the controller controls the recording head to eject the liquid droplets from the plurality of nozzle groups on the basis of the recording data to form at least one line, wherein the controller includes: a first judging section configured to divide the recording data corresponding to a predetermined number of lines as a maximum number of lines recordable on the recording medium during a single movement of the carriage in one of the second direction and the third direction, into a plurality of sets of recording data respectively corresponding to a plurality of unit areas each having at least one line that is fewer than the predetermined number of lines, the first judging section being configured to judge whether a ratio of the number of dots each required for the ejection of the liquid droplets of at least two of the plurality of colors in each of the plurality of unit areas to the number of all dots in said each of the plurality of unit areas is equal to or greater than a first threshold value or not; and a first recording executing section configured to execute the two-way recording processing on the basis of first recording data included in the recording data corresponding to the predetermined number of lines, the first recording data being data based on which the recording head ejects the liquid droplets onto the recording medium on a downstream side, in the first direction, of a unit area for which the first judging section has judged that the ratio is equal to or greater than the first threshold value, the first recording executing section being configured to execute the one-way recording processing on the basis of second recording data that includes at least recording data corresponding to said unit area for which the first judging section has judged that the ratio is equal to or greater than the first threshold value and recording data based on which the recording head ejects the liquid droplets onto the recording medium on an upstream side of said unit area in the first direction, wherein the recording data corresponding to said unit area for which the first judging section has judged that the ratio is equal to or greater than the first threshold value and the recording data based on which the recording head ejects the liquid droplets onto the recording medium on an upstream side of said unit area in the first direction are included in the recording data corresponding to the predetermined number of lines.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which:

FIGS. 11A-11D are schematic views showing an image recorded on the recording sheet 19 and a moving direction of the recording portion 24 during the recording of the image, wherein FIG. 11A shows the image to be recorded on the recording sheet 19, FIG. 11B shows a moving path of the recording portion 24 where the image is recorded by a first processing, FIG. 11C shows a moving path of the recording portion 24 where the image is recorded by a second processing, and FIG. 11D shows a moving path of the recording portion 24 where only a two-way recording processing is executed;

DETAILED DESCRIPTION OF THE EMBODIMENT

Hereinafter, there will be described an embodiment of the present invention by reference to the drawings. It is to be understood that the following embodiment is described only by way of example, and the invention may be otherwise embodied with various modifications without departing from the scope and spirit of the invention. In the following explanation, there will be expressed (a) upward and downward directions 14 on the basis of a state in which a multi-function device (MFD) 1 is normally used or placed (i.e., a state of the MFD 1 in FIG. 1), (b) frontward and rearward directions 12 by regarding a side of the MFD 1 on which an operation panel 9 is provided as a front side, and (c) rightward and leftward directions 13 in a state in which the MFD 1 is seen from the front.

<MFD 1>

Figure 1:
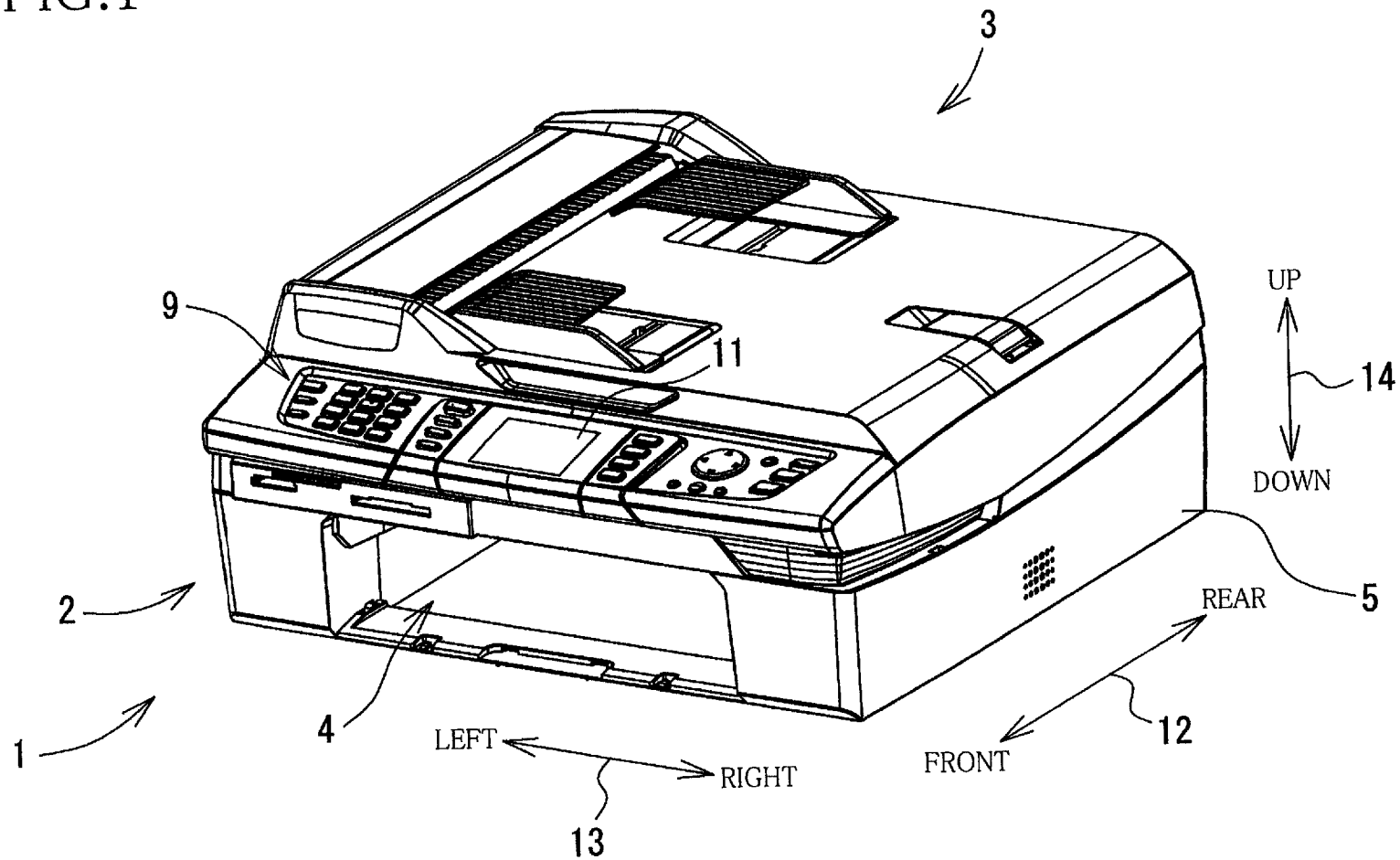
FIG. 1 is an external perspective view showing a multi-function device (MFD) 1 as one embodiment of the present invention.

As shown in FIG. 1, the MFD 1 as one example of an ink-jet recording apparatus of the present invention is a multi-function device which mainly includes a printing section 2 disposed at a lower portion thereof and a scanning section 3 disposed on the printing section 2. The MFD 1 has various functions such as a printing function, a scanning function, a copying function, and a facsimile function.

This MFD 1 has a one-side image recording function as the printing function but may have a two-side image recording function. It is noted that the functions other than the printer function such as the scanning function and the facsimile function are optional, and thus this image recording apparatus may be configured as a printer having only the printing function, for example. It is further noted that the scanning section 3 is an optional component for the present invention, and thus a detailed explanation thereof is dispensed with.

The MFD 1 is used in a state in which the MFD 1 is connected to an external device, not shown, such as a computer. The printing section 2 records or prints an image on a recording medium in the form of a recording sheet 19 on the basis of recording data received from the external device or recording data of a document read or scanned by the scanning section 3.

The operational panel 9 for operating the printing section 2 and the scanning section 3 is provided on an upper front portion of the MFD 1 which is located on a front side of the scanning section 3. The operational panel 9 is constituted by various operational buttons and a liquid crystal display portion 11. The MFD 1 is controlled and operated by a controller 130 (see FIG. 4) on the basis of a command outputted from the operational panel 9 or transmitted from an external device via a printer driver or a scanner driver, for example.

<Printing Section 2>

As shown in FIG. 1, the printing section 2 includes a casing 5 having an opening 4 on its front face. Components of the printing section 2 are disposed in the casing 5.

A sheet-supply tray 20 and a sheet-discharge tray 21 (see FIG. 2) are inserted into or removed from the MFD 1 through the opening 4. It is noted that illustrations of the sheet-supply tray 20 and the sheet-discharge tray 21 are omitted in FIG. 1. The sheet-supply tray 20 can accommodate thereon the recording sheets 19 of various sizes such as an A4 size and a B5 size. The sheet-discharge tray 21 is supported by the sheet-supply tray 20 and disposed on an upper side of the sheet-supply tray 20.

Figure 2:
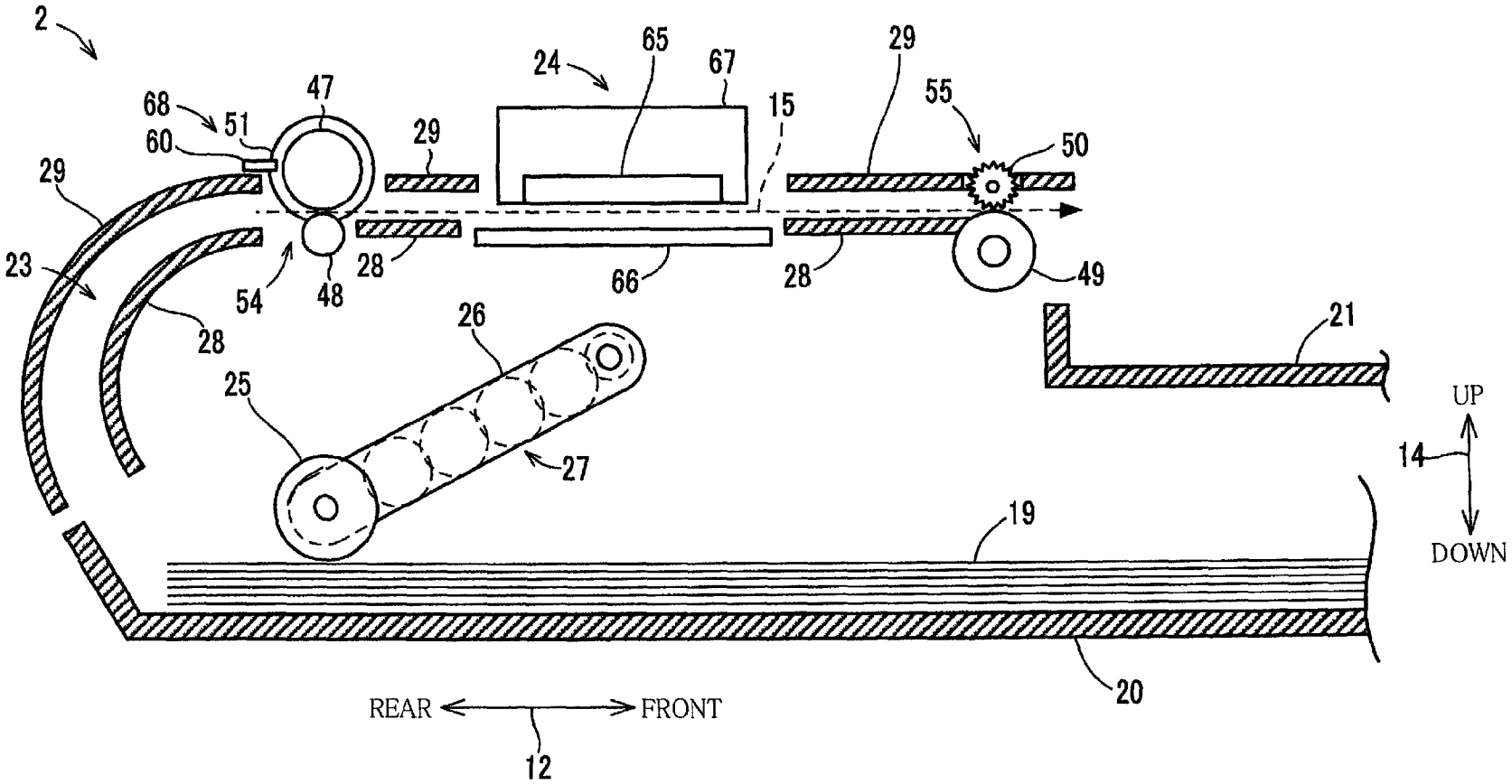
FIG. 2 is an elevational view in vertical cross section schematically showing an internal structure of a printing section 2.

As shown in FIG. 2, a sheet-supply roller 25 is provided above the sheet-supply tray 20. The sheet-supply roller 25 is supported by a lower end portion of a sheet-supply arm 26 pivotable upward and downward so as to be moved toward and away from the sheet-supply tray 20. The sheet-supply roller 25 is rotated by a drive power of a sheet-supply motor 76 (see FIG. 4) which is transmitted by a drive-power transmitting mechanism 27 including a plurality of gears meshed with one another. When the sheet-supply arm 26 is pivoted downward, the sheet-supply roller 25 is brought into pressing contact with an uppermost one of the recording sheets 19 on the sheet-supply tray 20. In this state, the sheet-supply roller 25 is rotated to supply the recording sheet 19 to a conveying path 23 explained below.

The conveying path 23 curves upward from a position on a rear side of the sheet-supply tray 20 and extends from the rear side to the front side. The conveying path 23 then passes through a nipping position of a convey-roller pair 54 (as one example of a conveying mechanism), a position under a recording portion 24, and a nipping position of a discharging-roller pair 55 (as another example of the conveying mechanism) and reaches the sheet-discharge tray 21. The recording sheet 19 supplied from the sheet-supply tray 20 is guided by the conveying path 23 so as to make an upward U-turn and reach the recording portion 24. The recording portion 24 performs an image recording on the recording sheet 19, and then the recording sheet 19 is discharged onto the sheet-discharge tray 21. The conveying path 23 is defined by an inner guide face 28 and an outer guide face 29 facing each other with a predetermined distance interposed therebetween, except a portion thereof where components such as the recording portion 24 are disposed.

Here, a direction indicated by broken-line arrow in FIG. 2 is defined as a conveyance direction 15 as one example of a first direction. That is, the conveyance direction 15 is a direction in which the recording sheet 19 is conveyed from the nipping position of the convey-roller pair 54 to the sheet-discharge tray 21 through the position under the recording portion 24 and the nipping position of the discharging-roller pair 55.

As shown in FIG. 2, the convey-roller pair 54 is provided on an upstream side of the recording portion 24 in the conveyance direction 15. The convey-roller pair 54 is constituted by a conveying roller 47 and a pinch roller 48. The discharging-roller pair 55 constituted by a sheet-discharge roller 49 and a spur 50 is provided on a downstream side of the recording portion 24 in the conveyance direction 15.

The conveying roller 47 and the sheet-discharge roller 49 are rotated by a drive power transmitted from a conveyance motor 59 (see FIG. 4) through a drive-power transmitting mechanism, not shown. When the conveying roller 47 is rotated forwardly (i.e., in a counterclockwise direction in FIG. 2), the recording sheet 19 supplied from the sheet-supply tray 20 is conveyed in the conveyance direction 15 by being nipped by the convey-roller pair 54. When the sheet-discharge roller 49 is rotated forwardly, the recording sheet 19 on which the image has been recorded by the recording portion 24 is conveyed in the conveyance direction 15 by being nipped by the discharging-roller pair 55.

As shown in FIG. 2, a rotary encoder 68 is provided for detecting a rotational amount of the conveying roller 47. The rotary encoder 68 is constituted by an optical sensor 60 and an encoder disc 51 provided coaxially with the conveying roller 47 and rotated with the conveying roller 47. The encoder disc 51 has light transmitting portions each of which transmits light and light intercepting portions each of which intercepts light. The light transmitting portions and the light intercepting portions are alternately arranged at predetermined pitches in a circumferential direction of the encoder disc 51 so as to form a predetermined pattern. In a state in which the encoder disc 51 is rotated with the conveying roller 47, a pulse signal is generated each time when the optical sensor 60 has detected a mark of the rotary encoder 68. The pulse signal is outputted to the controller 130.

<Recording Portion 24>

The recording portion 24 records an image on the recording sheet 19 conveyed through the conveying path 23 in the conveyance direction 15. The recording portion 24 performs the image recording by an ink-jet method. The recording portion 24 mainly includes a recording head 65, a platen 66, and a carriage 67.

The carriage 67 is provided on an upper side of the conveying path 23. The carriage 67 is supported by two guide rails, not shown, mounted on a frame, not shown, provided in the printing section 2, for example. Specifically, the two guide rails extend in the rightward and leftward directions 13. Further, the two guide rails are disposed with a predetermined distance interposed therebetween in the frontward and rearward directions 12. The carriage 67 is mounted on the two guide rails so as to bridge the two guide rails. The carriage 67 is thus slidable and movable on the two guide rails in the rightward and leftward directions 13. On upper faces of the guide rails, there is provided a belt driving mechanism, not shown. A belt partly constituting the belt driving mechanism is connected to the carriage 67. When a drive power is transmitted from a carriage drive motor 103 (see FIG. 4) to the belt driving mechanism, the carriage 67 is slid in the rightward and leftward directions 13.

That is, in the present embodiment, the carriage 67 is reciprocable in a rightward direction (as one example of a second direction) and a leftward direction (as one example of a third direction) each perpendicular to the conveyance direction 15 and along an image recording face of the recording sheet 19. The carriage 67 is controlled by the controller 130 (which will be described below) to alternately repeat movement in the rightward direction and movement in the leftward direction. It is noted that the leftward direction and the rightward direction may be the second direction and the third direction, respectively.

An encoder strip, not shown, of a linear encoder 42 (see FIG. 4) is provided on the guide rails. The encoder strip has light transmitting portions each of which transmits light and light intercepting portions each of which intercepts light. The light transmitting portions and the light intercepting portions are alternately arranged at predetermined pitches so as to form a predetermined pattern. On the carriage 67 is mounted an optical sensor, not shown, for detecting the pattern of the encoder strip. A pulse signal is generated each time when the optical sensor has detected a mark of the encoder strip. The pulse signal is outputted to the controller 130.

Inks of four colors, namely, cyan (C), magenta (M), yellow (Y), and black (Bk) are supplied respectively from ink tanks, not shown, to the recording head 65 through four ink tubes, not shown. Each ink tube is formed of a synthetic resin having a flexibility so as to be deformed depending on the movement of the carriage 67. The four ink tubes respectively correspond to the inks of the four colors.

The recording head 65 is mounted on the carriage 67. The recording head 65 is exposed from a lower face of the carriage 67 so as to face the platen 66. The platen 66 is disposed below the conveying path 23 so as to face the carriage 67. The platen 66 supports the recording sheet 19. It is noted that the platen 66 has a width sufficiently wider in the rightward and leftward directions 13 than a width of a recording sheet 19 of a maximum size that can be used in this MFD 1. When the carriage 67 is reciprocated, the recording head 65 ejects the ink(s) while moving or scanning with respect to the recording sheet 19 located on the platen 66. An ink droplet or ink droplets ejected from the recording head 65 is or are landed on the recording sheet 19, that is, the image recording is performed.

Figure 3:
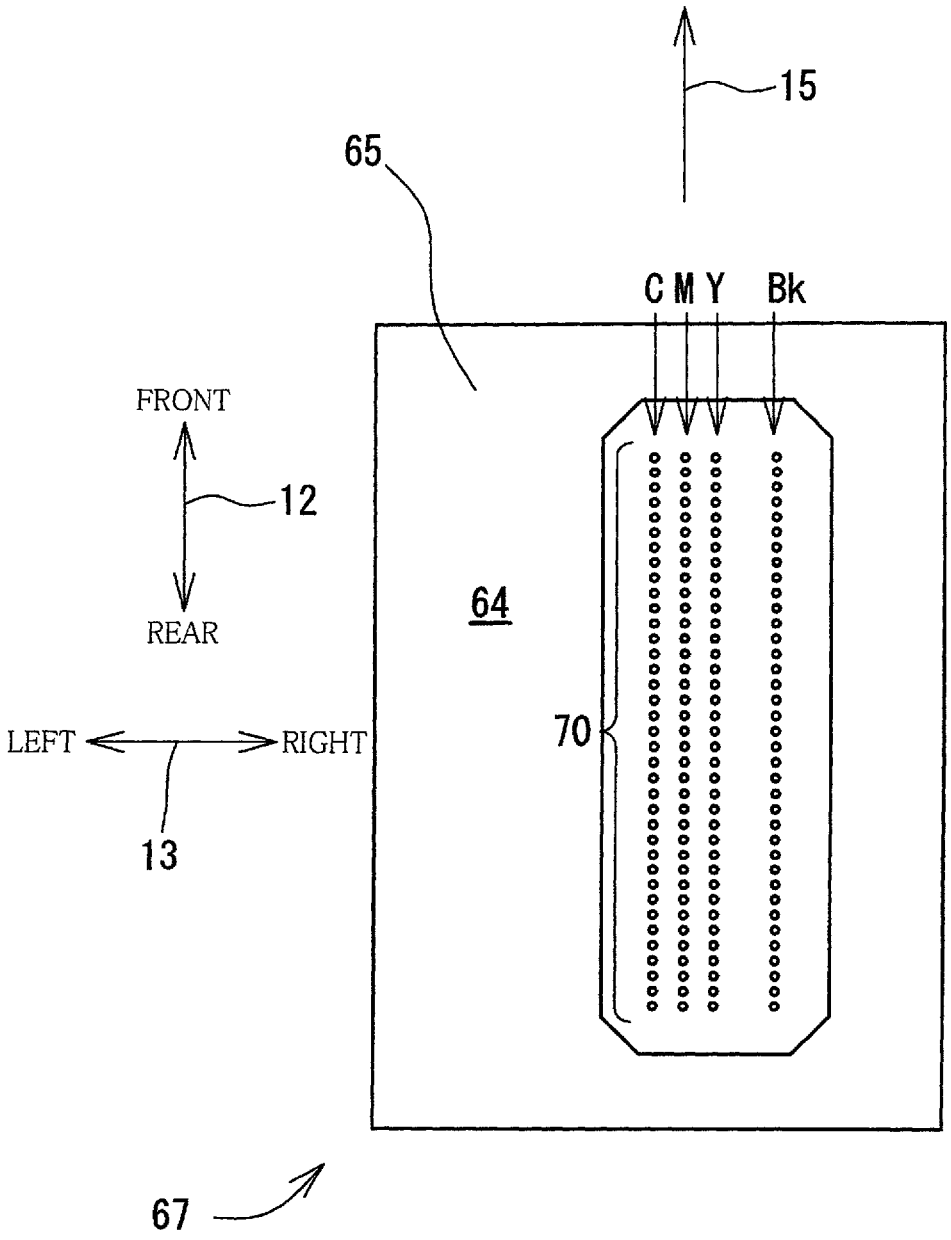
FIG. 3 is a plan view showing a lower face 64 of a recording head 65.

As shown in FIG. 3, the recording head 65 has a lower face 64 (as one example of a nozzle face) having a plurality of nozzles formed therein. The nozzles open in the lower face 64 so as to form ejection openings 70. Each of the ejection openings 70 corresponds to one of the four colors: cyan (C); magenta (M); yellow (Y); and black (Bk). It is noted that, in FIG. 3, the recording sheet 19 is conveyed from a lower side toward an upper side (in the conveyance direction 15), and the carriage 67 is reciprocated in the rightward and leftward directions 13.

The ejection openings 70 corresponding to each color are arranged in a row in the conveyance direction 15, and the ejection-opening rows respectively corresponding to the four colors are arranged in the rightward and leftward directions 13 in which the carriage 67 is reciprocated. The number of the ejection openings 70 and pitches thereof in the conveyance direction 15 are appropriately set according to, e.g., a resolution of a recording image. Further, the number of the rows of the ejection openings 70 may be increased or reduced according to the number of colors of the ink. That is, the recording head 65 has the lower face 64 in which the predetermined number of the nozzles, each for ejecting one color ink, arranged in a predetermined order along the rightward and leftward directions 13 are arranged in the conveyance direction 15. It is noted that the predetermined number of the nozzles constitute a nozzle group.

The recording sheet 19 is intermittently conveyed on the platen 66 of the recording portion 24 in the conveyance direction 15 by a predetermined linefeed width by the conveying roller 47 and the sheet-discharge roller 49 controlled by the controller 130. While the conveyance of the recording sheet 19 is stopped, the recording head 65 selectively ejects the ink droplets onto the recording sheet 19 while moving in the rightward and leftward directions 13. The intermittent conveyance of the recording sheet 19 and the movement of the recording head 65 are repeated, whereby the image is recorded on the recording sheet 19.

For example, in the case where a black image is recorded on a specific portion of the recording sheet 19, the recording head 65 ejects only the black ink droplets onto the specific portion of the recording sheet 19 and does not eject ink droplets of the other colors. Further, in the case where a color image is recorded on a specific portion of the recording sheet 19, the recording head 65 ejects ink droplets of at least a single color among cyan, magenta, and yellow onto the specific portion of the recording sheet 19. Where the recording head 65 ejects the ink droplets while moving in the rightward direction, the ink droplets are ejected onto the specific portion in order of yellow, magenta, and cyan. On the other hand, where the recording head 65 ejects the ink droplets while moving in the leftward direction, the ink droplets are ejected onto the specific portion in order of cyan, magenta, and yellow.

In view of the above, the recording head 65 ejects the ink droplets of the single color or the multiple colors from the nozzles onto the conveying path 23 to record the image on the recording sheet 19.

<Controller 130>

Figure 4:
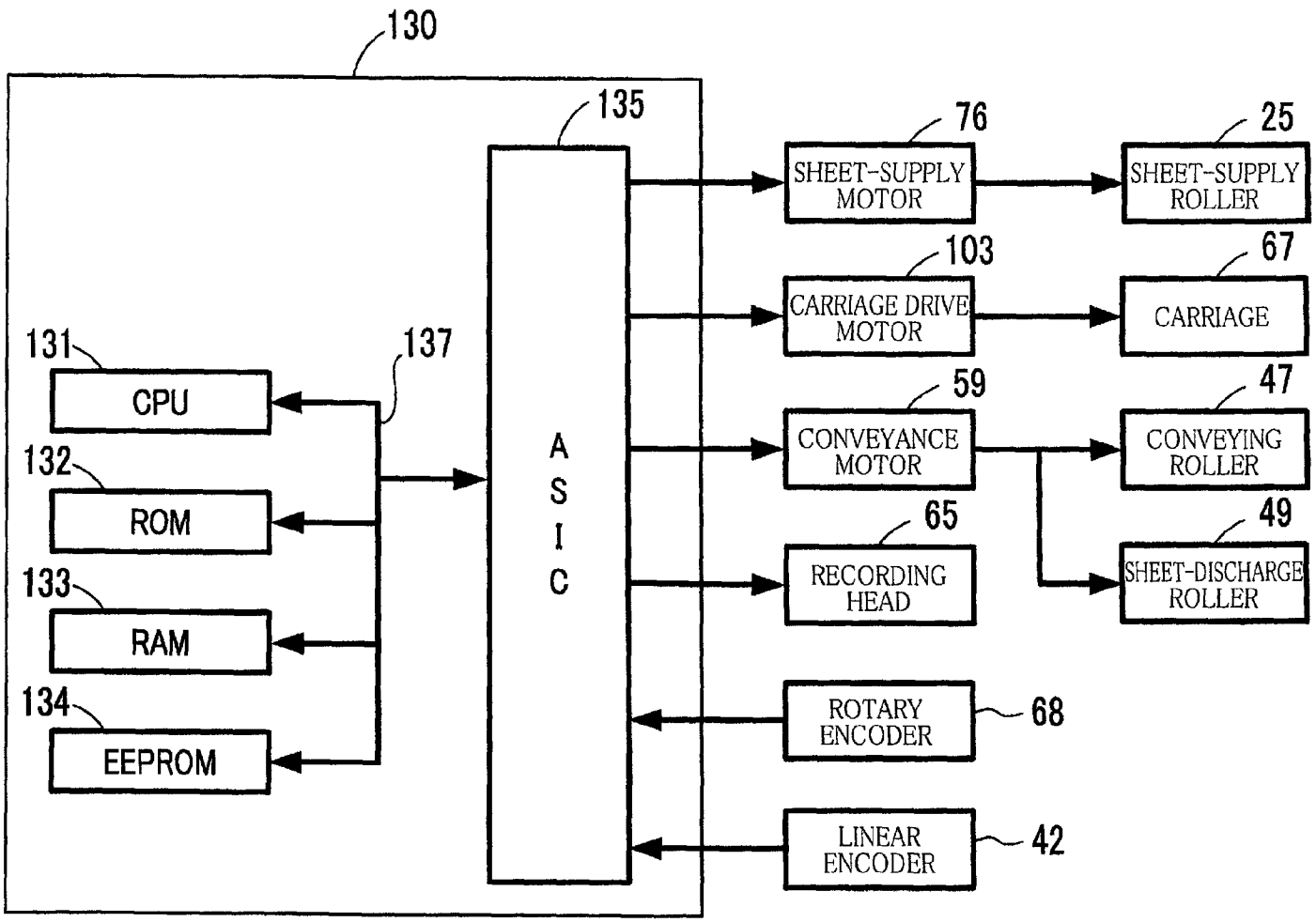
FIG. 4 is a block diagram showing a controller 130.

There will be next explained a general configuration of the controller 130 with reference to FIG. 4. The controller 130 executes a recording control according to a flow-chart which will be described below, thereby realizing the present invention.

The controller 130 is configured to control entire operations of the MFD 1. The controller 130 is constituted as a microcomputer mainly including a CPU 131, a ROM 132, a RAM 133, an EEPROM 134, and an ASIC 135. These are connected to one another via an internal bus 137.

The ROM 132 stores programs and so on for the CPU 131 to control various operations or processings (including the recording control of the MFD 1) of the MFD 1. The RAM 133 is used as a storage area for temporarily storing data, signals, and so on used when the CPU 131 performs the above-described programs or used as a working area for a data processing. The EEPROM 134 stores settings and flags and the like which are to be kept also after the MDF 1 is turned off.

To the ASIC 135 are connected the sheet-supply motor 76, the carriage drive motor 103, the conveyance motor 59, and the recording head 65. Drive circuits for controlling the motors are integrated in the ASIC 135. When a drive signal for rotating each motor is inputted from the CPU 131 to a drive circuit corresponding to a specific motor, a drive current according to the drive signal is outputted from the drive circuit to the corresponding motor. As a result, the corresponding motor is rotated forwardly or reversely at a predetermined rotational speed. That is, the controller 130 controls the sheet-supply motor 76, the carriage drive motor 103, and the conveyance motor 59.

To the ASIC 135, the pulse signal outputted from the rotary encoder 68 and the pulse signal outputted from the linear encoder 42 are inputted. The controller 130 calculates the rotational amount of the conveying roller 47 on the basis of the pulse signal outputted from the rotary encoder 68 and outputs the drive signal to the drive circuit for rotating the conveyance motor 59, such that the calculated rotational amount coincides with a target rotational amount. That is, the controller 130 controls the rotational amount of the conveying roller 47 on the basis of the pulse signal outputted from the rotary encoder 68. Further, the controller 130 calculates a speed and a position of the carriage 67 on the basis of the pulse signal outputted from the linear encoder 42 and outputs the drive signal to the drive circuit for rotating the carriage drive motor 103, such that the calculated speed or position coincides with the target speed or position. That is, the controller 130 controls the movement of the carriage 67 on the basis of the pulse signal outputted from the linear encoder 42.

When the image is recorded on the recording sheet 19, the controller 130 controls the conveyance motor 59 to temporarily stop the conveyance of the recording sheet 19 by the convey-roller pair 54 and the discharging-roller pair 55. The controller 130 then selectively executes the one-way recording processing and the two-way recording processing during the temporary stop of the conveyance of the recording sheet 19. Conditions of selections of the one-way recording processing and the two-way recording processing will be explained later with reference to FIGS. 5 and 6.

The one-way recording processing is a processing in which the ink droplet(s) are ejected from the nozzles while the carriage 67 is moved in the rightward direction, and no ink droplets are ejected from the nozzles when the carriage 67 is moved in the leftward direction. Here, the one-way recording processing is explained in detail. When executing the one-way recording processing, the controller 130 recognizes a current position of the carriage 67 on the basis of the pulse signal outputted from the linear encoder 42. Where the current position of the carriage 67 is located on a right side of an area on the recording sheet 19 on which the image recording is about to be performed, the controller 130 controls the carriage 67 to move in the leftward direction without the ejection of the ink droplets from the nozzles. As a result, the carriage 67 is moved to a position on a left side of the area. The controller 130 then controls the carriage 67 to move in the rightward direction while controlling the recording head 65 to eject the ink droplets from the nozzles. On the other hand, where the current position of the carriage 67 is located on a left side of an area on the recording sheet 19 on which the image recording is about to be performed, the controller 130 controls the carriage 67 to move in the rightward direction while controlling the recording head 65 to eject the ink droplets from the nozzles.

The two-way recording processing is a processing in which the ink droplet(s) are ejected from the nozzles while the carriage 67 is moved in the rightward direction and the leftward direction. Here, the two-way recording processing is explained in detail. When executing the two-way recording processing, the controller 130 recognizes the current position of the carriage 67 on the basis of the pulse signal outputted from the linear encoder 42. Where the current position of the carriage 67 is located on a right side of an area on the recording sheet 19 on which the image recording is about to be performed, the controller 130 controls the carriage 67 to move in the leftward direction while controlling the recording head 65 to eject the ink droplets from the nozzles. On the other hand, where the current position of the carriage 67 is located on a left side of the area, the controller 130 controls the carriage 67 to move in the rightward direction while controlling the recording head 65 to eject the ink droplets from the nozzles. That is, both in the cases where the moving direction of the carriage 67 is the rightward direction and the leftward directions, the controller 130 moves the carriage 67 while controlling the recording head 65 to eject the ink droplets from the nozzles.

Figure 8:
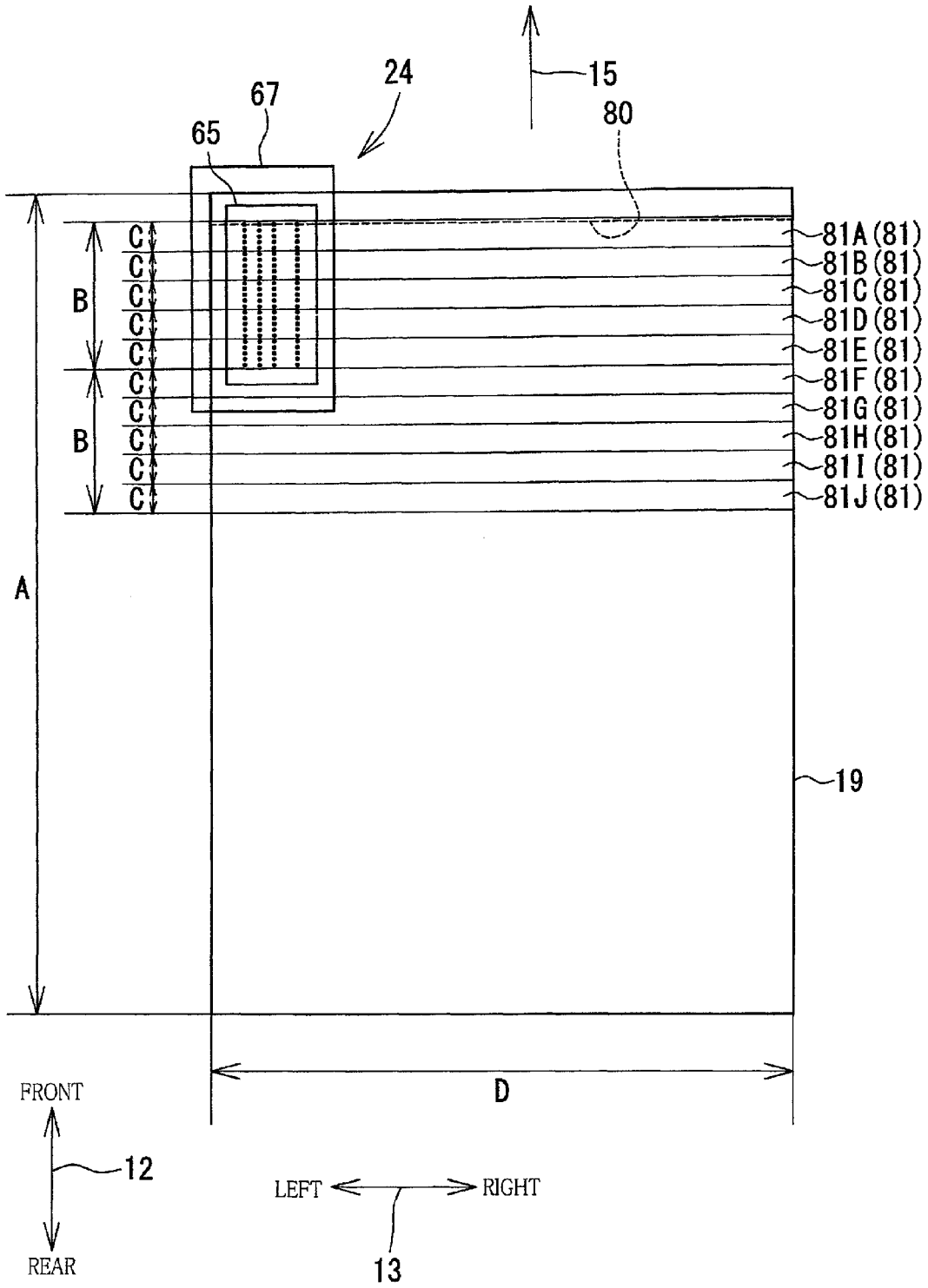
FIG. 8 is a plan view schematically showing a recording portion 24 and a recording sheet 19.

As shown in FIG. 8, while the carriage 67 is moved in the rightward and leftward directions 13, the nozzles formed in the recording head 65 (indicated by a plurality of circles in FIG. 8) are moved above the recording sheet 19 along lines 80. It is noted that FIG. 8 shows only one line 80 (indicated by a broken line) as a moving path of the nozzles formed at a most downstream position in the conveyance direction 15, but in reality, all the nozzles are moved along paths parallel to the lines 80.

When the carriage 67 is moved, the ink droplets are ejected from the nozzles, whereby the image is recorded on the recording sheet 19 along the lines 80. It is noted that, though not shown in FIG. 8, each of the lines 80 is a collection of dots (indicated by black circles and hatch circles in FIGS. 9A and 9B, for example) arranged in a row in the rightward and leftward directions 13.

The controller 130 determines how many types (colors) of the inks are ejected onto each dot among the inks of four colors on the basis of the recording data. The controller 130 then controls the recording head 65 to eject the ink(s) according to the determination. As a result, the image is recorded on the recording sheet 19 along the lines 80.

<Recording Control>

The controller 130 executes the recording control by controlling the printing section 2 having the above described construction to perform the image recording (including the supply of the sheet, the recording, and so on). There will be next explained the recording control with reference to flowcharts in FIGS. 5 and 6.

When an image recording command is inputted to the MFD 1 from the external device or the operation panel 9, the controller 130 drives the sheet-supply motor 76 to rotate the sheet-supply roller 25. As a result, each recording sheet 19 accommodated on the sheet-supply tray 20 is conveyed toward the convey-roller pair 54 along the conveying path 23. The controller 130 drives the conveyance motor 59 to rotate the conveying roller 47. As a result, the recording sheet 19 supplied by the sheet-supply roller 25 is conveyed along the conveying path 23 toward the position just under the recording head 65.

The controller 130 controls the rollers to convey the recording sheet 19 to a starting position of the image recording. Here, the starting position of the image recording is a position in which a position of the leading end (the downstream end in the conveyance direction 15) of the conveyed recording sheet 19 coincides with positions of the nozzles in the frontward and rearward directions 12. In other words, the starting position of the image recording is a position at which the leading end of the conveyed recording sheet 19 can face the nozzles.

The controller 130 initializes parameters used in the recording control, by the time when the conveyed recording sheet 19 reaches the position just under the recording head 65. The parameters include a pass number N, a one-page completed line number, a one-pass completed line number, a pass first line, a few-color area number, a many-color area number, a division flag, and a one-pass total color-dot number (the total number of color dots in one pass).

In S10, the controller 130 sets the one-page completed line number and the pass number N at zero and sets the division flag at "OFF". In S20, the controller 130 sets the pass first line at a value obtained by adding one to the one-page completed line number. In S30, the controller 130 sets the one-pass completed line number, the few-color area number, the many-color area number, and the one-pass total color-dot number at zero.

The pass number N (hereinafter may also be called "N pass") is the number of passes during a process of the image recording on the recording sheet 19. Here, a pass is a unit in which the recording head 65 ejects the ink droplets to perform the image recording during a single movement of the carriage 67 in the rightward direction or the leftward direction. For example, in the case where the image recording is performed during the movement of the carriage 67 in the rightward direction in a state in which the pass number N is zero, the image recording corresponds to first pass. Further, in the case where the image recording is performed during the movement of the carriage 67 in the leftward direction after the movement of the carriage 67 in the rightward direction, the image recording corresponds to second pass.

The one-page completed line number is the number of lines corresponding to recording data for which a specific judgment has been executed by the controller 130, among recording data corresponding to lines constituting a single page of the recording sheet 19 (i.e., lines contained in a range A in the frontward and rearward directions 12 in FIG. 8). Here, the specific judgment is a judgment executed in S40 and subsequent steps which will be described below.

The one-pass completed line number is the number of lines corresponding to recording data for which the specific judgment has been executed by the controller 130, among recording data corresponding to lines for which the image recording is performed in one pass. Here, the specific judgment is a judgment executed in S40 and subsequent steps. Further, the number of the lines for which the image recording is performed in one pass is a maximum line number that is the number of maximum lines on which the recording can be performed on the recording sheet 19 during a single movement of the carriage 67 in the rightward direction or the leftward direction. In the present embodiment, the number of the lines for which the image recording is performed in one pass corresponds to the number of the nozzles arranged in the lower face of the recording head 65 in the conveyance direction 15, i.e., the predetermined number of the nozzles explained with reference to FIG. 3. Specifically, the maximum line number in which the image recording is performed in one pass is the number of lines contained in a range B in the frontward and rearward directions 12 in FIG. 8.

The pass first line is a line formed in the pass by ink droplets ejected from the most downstream one of the nozzles in the conveyance direction 15. For example, in the case shown in FIG. 8, the pass first line is the line 80 indicated by the broken line.

In the present embodiment, an image recording range on the recording sheet 19 is assumed to be divided into a plurality of unit areas 81 (see FIG. 8). The few-color area number is the number of unit areas 81 on each of which a ratio of dots other than the black dots to all dots in the unit area 81 is lower than a predetermined ratio which will be described below. Here, as shown in FIG. 8, a length of each of the unit areas 81 in the rightward and leftward directions 13 is the same as an image recordable range D of the recording head 65 that is determined on the basis of a movable area of the carriage 67 (that is, the image recordable range D is a length of the recording sheet 19 in the rightward and leftward directions 13 in FIG. 8), and a length of each of the unit areas 81 in the frontward and rearward directions 12 is the same as a range C corresponding to the line number (the number of lines) that is smaller than the line number corresponding to the range B (i.e., the above-described predetermined number of the nozzles). It is noted that the line number corresponding to the range C is at least one. It is further noted that FIG. 8 shows only an upper part of the unit areas 81 on the recording sheet 19.

The many-color area number is the number of unit areas 81 on each of which the ratio of the dots other than the black dots to the all dots in the unit area 81 is equal to or higher than the predetermined ratio, in other words, the many-color area number is the number of the unit areas 81 on each of which the ratio of the color dots to all the dots in the unit area 81 is equal to or higher than the predetermined ratio.

The division flag is a flag indicating that the image recording is performed for a few-color area in S210.

The one-pass total color-dot number is a total number of the color dots (other than the black dots) among dots constituting recording data corresponding to the lines for which the image recording is performed in one pass (i.e., the lines contained in the range B in the frontward and rearward directions 12 in FIG. 8).

Figure 5:
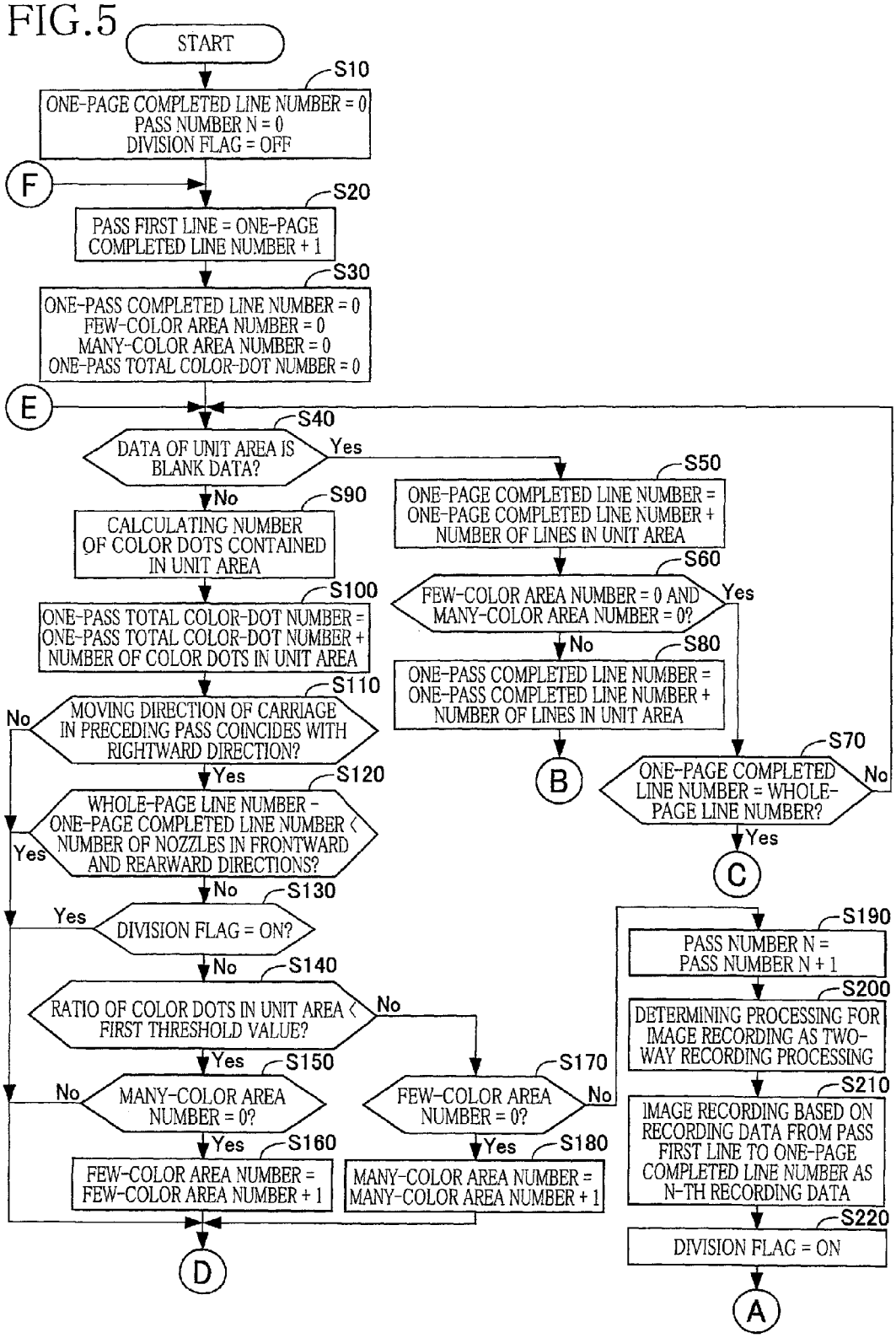
FIG. 5 is a flow-chart for explaining a recording control.

There will be next explained processings of S40 and subsequent steps in FIG. 5. First, an overall processing is explained. The controller 130 initially executes judgments in S40 and S140 for a unit area 81A that is located at the most downstream side in the conveyance direction 15 among the plurality of the unit areas 81. Next, when the processing in S40 is executed after a processing S70 or S250 is executed, the controller 130 executes the judgments in S40 and S140 for a unit area 81B whose most downstream end in the conveyance direction 15 corresponds to a line corresponding to a value of the one-page completed line number increased in S50 and S240. Thereafter, the controller 130 executes the judgments in S40 and S140 in alphabetical order in FIGS. 8 and 9A, 9B such as the unit area 81C and the unit area 81D.

The judgments in S40 and S140 for the unit areas 81 are executed in the above-described order until a total number of lines of the unit areas 81 for which the judgments have been executed has reached the line number corresponding to the range B (i.e., the above-described predetermined number of the nozzles). The judgment as to whether the total number has reached the line number corresponding to the range B or not is executed in S250. Where the controller 130 has judged that the total number has reached the line number (S250: Yes), the ink droplets are in S300 ejected onto each of the unit areas 81 on the basis of the recording data. It is noted that a first line in S300 is the unit area 81 for which the judgment in S140 has been judged first. Then, the controller 130 repeats the above-described processings until the controller 130 has judged in S320 that the image recording is completed for the whole area on one page of the recording sheet 19. As described above, the controller 130 executes the judgments in S40 and S140 for each of the unit areas 81 corresponding to the recording data that corresponds to the range B (the predetermined lines in the recording data).

For example, in FIG. 8, the judgments are initially executed for the unit areas 81 one by one in order from the unit area 81A to a unit area 81E, and thereafter the ink droplets are ejected onto the unit areas 81A-81E. The judgments are repeatedly executed for the unit areas 81 in order from a unit area 81F to a unit area 81J, and thereafter the ink droplets are ejected onto the unit areas 81F-81J. It is noted that, as will be described below, where processings in S190 and subsequent steps are executed, the ink droplets are ejected onto the unit areas 81 different from the above-described unit areas 81.

Here, the processing in each step is explained in detail. In S40, the controller 130 judges whether recording data of a unit area 81 (e.g., the unit area 81A in FIGS. 8 and 9A) whose most downstream end in the conveyance direction 15 corresponds to a line (a 0th line at first) corresponding to the one-page completed line number ("0" set in S10 at first) is blank data or not. Here, the blank data is data that indicates that the ink is not to be ejected onto all the dots. It is noted that, in FIGS. 9A and 9B, each of circles represents a dot of the recording data. Specifically, black circles represent the black dots, and hatch circles represent the color dots other than the black dots.

Where the controller 130 has judged in S40 that the recording data of the unit area 81 is the blank data (S40: Yes), the controller 130 in S50 adds the number of the lines in the unit area 81 to the one-page completed line number. In S60, the controller 130 judges whether each of both of the few-color area number and the many-color area number is zero or not. Here, a case where each of both of the few-color area number and the many-color area number is zero (S60: Yes) is a case where the unit area 81 is an area corresponding to a margin of the leading end portion and a trailing end portion of the recording sheet 19 in the conveyance direction 15, for example. On the other hand, a case where one of the few-color area number and the many-color area number is not zero (S60: No), the unit area 81 is an area corresponding to a margin located on a central portion of the recording sheet 19 in the conveyance direction 15, for example.

Where the controller 130 has judged that each of both of the few-color area number and the many-color area number is zero (S60: Yes), the controller 130 in S70 judges whether the one-page completed line number is equal to the whole-page line number (the line number of the range A in the frontward and rearward directions 12 in FIG. 8) or not. Where the controller 130 has judged that the one-page completed line number is equal to the whole-page line number (S70: Yes), the controller 130 judges that an image based on the recording data has been recorded on a whole area of one page of the recording sheet 19 and finishes this recording control. Where the controller 130 has judged that the one-page completed line number is not equal to the whole-page line number (S70: No), the controller 130 judges that an unrecorded area for which the image recording is to be performed based on the recording data exists on the recording sheet 19, and the controller 130 executes the processing in S40 again.

On the other hand, where the controller 130 has judged that the few-color area number or the many-color area number is not zero (S60: No), the controller 130 in S80 adds the number of the lines in the unit area 81 to the one-pass completed line number. Then in S250, the controller 130 judges whether the one-pass completed line number is equal to the above-described predetermined number of the nozzles (i.e., the number of the lines contained in the range B) or not. Where the controller 130 has judged that the one-pass completed line number is not equal to the above-described predetermined number of the nozzles (S250: No), the controller 130 judges that a line or lines for which the judgment in S40 has not been executed exist among the lines corresponding to the range B, and the controller 130 executes the processing in S40 again. Where the controller 130 has judged that the one-pass completed line number is equal to the above-described predetermined number of the nozzles (S250: Yes), the controller 130 judges that the judgment in S40 has been executed for all the lines corresponding to the range B and executes a processing in S260 which will be described below. As a result, in S300 which will be described below, the ink droplets are ejected on the recording sheet 19 on the basis of the recording data corresponding to the lines that corresponds to the range B.

Where the controller 130 has judged in S40 that the recording data of the unit area 81 is not the blank data (S40: No), the controller 130 in S90 calculates the number of the color dots contained in the unit area 81. For example, where a configuration (arrangement) of the dots of the recording data is a configuration shown in FIG. 9A, the controller 130 executes the calculation and obtains "2" as the number of the color dots in the unit area 81 (that is assumed to be the unit area 81A for which the judgment is executed first). Then in S100, the controller 130 adds the number of the color dots calculated in S90 to the one-pass total color-dot number. As a result, the number of the color dots is accumulatively added.

Then in S110, the controller 130 judges whether the moving direction of the carriage 67 in the preceding pass coincides with the rightward direction or not, that is, the controller 130 judges whether the moving direction of the carriage 67 in the current pass coincides with the leftward direction or not. Where the controller 130 has judged that the moving direction of the carriage 67 in the preceding pass coincides with the leftward direction, that is, where the controller 130 has judged that the moving direction of the carriage 67 in the current pass coincides with the rightward direction (S110: No), the controller 130 then executes a processing in S230. That is, the processing in S140 is not executed. On the other hand, where the controller 130 has judged that the moving direction of the carriage 67 in the preceding pass coincides with the rightward direction, that is, where the controller 130 has judged that the moving direction of the carriage 67 in the current pass coincides with the leftward direction (S110: Yes), the controller 130 executes the processing in S140 on conditions that conditions in S120 and S130 explained below are not satisfied.

In S120, the controller 130 judges whether or not a value obtained by reducing the one-page completed line number from the whole-page line number is less than the line number (the above-described predetermined number of the nozzles) corresponding to the range B in the frontward and rearward directions 12. In other words, the controller 130 judges whether the image recording can be completed for the entire recording sheet by one movement of the carriage 67 at this point in time or not. Where the controller 130 has judged that the value obtained by reducing the one-page completed line number from the whole-page line number is less than the line number corresponding to the range B in the frontward and rearward directions 12 (S120: Yes), the processing in S230 is executed. That is, the processing in S140 is not executed. On the other hand, where the controller 130 has judged that the value obtained by reducing the one-page completed line number from the whole-page line number is equal to or greater than the line number corresponding to the range B in the frontward and rearward directions 12 (S120: No), the controller 130 executes the processing in S140 on conditions that the condition in S130 explained below is not satisfied.

In S130, the controller 130 judges whether the division flag is "ON" or "OFF". Where the controller 130 has judged that the division flag is "ON" (S130: Yes), the processing in S230 is executed. On the other hand, where the controller 130 has judged that the division flag is "OFF" (S130: No), the processing in S140 is executed.

In S140, the controller 130 judges whether the ratio of the color dots in the unit area 81 is less than a first threshold value or not. Here, the first threshold value is a value for setting the unit area 81 (a judgment object) as the many-color area or the few-color area. In the present embodiment, a unit of the first threshold value is a percentage (%), and specifically, the first threshold value is set at 20(%). It is noted that the first threshold value is not limited to the unit and the value set in the present embodiment. Where the controller 130 has judged that the ratio of the color dots in the unit area 81 is less than the first threshold value (S140: Yes), the controller 130 judges that the unit area 81 is the few-color area. Where the controller 130 has judged that the ratio of the color dots in the unit area 81 is equal to or higher the first threshold value (S140: No), the controller 130 judges that the unit area 81 is the many-color area.

Figure 9A:
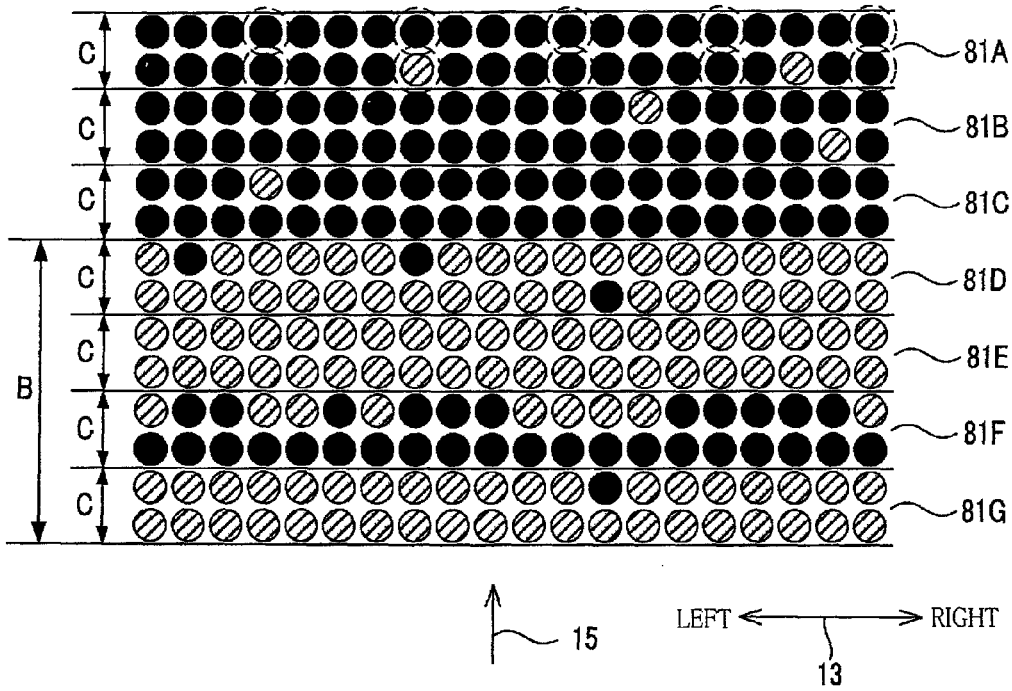
FIGS. 9A and 9B are schematic views showing dots to be recorded on the recording sheet 19.

For example, where a configuration of the dots of the recording data is the configuration shown in FIG. 9A, the ratio of the color dots in the unit area 81 (that is assumed to be the unit area 81A for which the judgment is executed first) is 5(%) (=(2/40)×100). This value is less than 20(%) of the first threshold value. Thus, the controller 130 judges that the unit area 81A is the few-color area.

In view of the above, the controller 130 in S140 judges whether the ratio of the dots (the color dots in the present embodiment) required for the ejection of the ink droplets of the multiple colors on the recording sheet 19, to all the dots constituting the unit area 81 is equal to or greater than the first threshold value or not for each of the unit areas 81 (the recording data corresponding to the lines contained in the range C) in the recording data of the predetermined number of the lines (the recording data corresponding to the lines contained in the range B). It is noted that the controller 130 can be considered to include a first judging section configured to execute a processing in S140, for example. Further, the controller 130 executes the processing in S140 on the condition that the moving direction of the carriage 67 in the current pass coincides with the leftward direction (S110: Yes). Further, the controller 130 executes the processing in S140 on the condition that the line number of remaining recording data based on which the ink droplets have not been ejected onto the recording sheet 19 is equal to or greater than the above-described predetermined number of the nozzles (S120: No).

Where the controller 130 has judged that the unit area 81 is the few-color area as a result of the judgment of S140 (S140: Yes), the controller 130 in S150 judges whether the many-color area number is zero or not. Where the controller 130 has judged that the many-color area number is zero (S150: Yes), one is add to the few-color area number in S160. Where the controller 130 has judged that the many-color area number is not zero (S150: No), the processing in S230 is executed.

On the other hand, where the controller 130 has judged that the unit area 81 is the many-color area as a result of the judgment of S140 (S140: No), the controller 130 in S170 judges whether the few-color area number is zero or not. Where the controller 130 has judged that the few-color area number is zero (S170: Yes), one is added to the many-color area number in S180. Where the controller 130 has judged that the few-color area number is not zero (S170: No), the processing in S190 is executed.

In S200 and S210, the controller 130 controls the recording head 65 to eject the ink droplets onto the recording sheet 19 by the two-way recording processing on the basis of recording data (first recording data) for the ink ejection onto the recording sheet 19 on a downstream side, in the conveyance direction 15, of the unit area 81 judged in S140 that the ratio thereof is equal to or greater than the first threshold value, in the recording data corresponding to the above-described predetermined number of the lines of the nozzles (i.e., the lines contained in the range B). Further, in S270, S280, and S300, the controller 130 controls the recording head 65 to eject the ink droplets onto the recording sheet 19 by the one-way recording processing on the basis of recording data including (i) the recording data corresponding to the unit area 81 judged in S140 that the ratio thereof is equal to or greater than the first threshold value (i.e., the recording data corresponding to the unit area 81 that is a first unit area judged that the ratio thereof is equal to or greater than the first threshold value) and (ii) recording data (second recording data) for the ink ejection onto the recording sheet 19 on an upstream side of the unit area 81 in the conveyance direction 15.

In S190, the controller 130 adds one to the pass number N. Then in S200, the controller 130 determines the processing in which the image recording is performed on the recording sheet 19 on the basis of the first recording data, as the above-described two-way recording processing. Then in S210, the controller 130 controls the recording head 65 to perform the image recording on the recording sheet 19 on the basis of recording data from the pass first line set in S20 to the one-page completed line number at this point in time as N-th recording data. That is, the controller 130 controls the recording head 65 to eject the ink droplets from the nozzles on the basis of the recording data while moving the carriage 67 in the leftward direction (since the moving direction of the carriage 67 in the preceding pass in S110 is the rightward direction, the moving direction of the carriage 67 in the current pass is the leftward direction). In S220, the controller 130 changes the division flag to "ON".

Then in S320, the controller 130 judges whether the one-page completed line number is equal to the whole-page line number (the line number of the range A in the frontward and rearward directions 12 in FIG. 8) or not. Where the controller 130 has judged that the one-page completed line number is equal to the whole-page line number (S320: Yes), the controller 130 judges that the image recording is performed on the entire recording sheet 19 on the basis of the recording data and finishes this recording control. Where the controller 130 has judged that the one-page completed line number is not equal to the whole-page line number (S320: No), the processing in S20 is executed again.

Next, processings in S230 and subsequent steps are explained. In S230, the controller 130 adds the number of the lines in the unit area 81 to the one-pass completed line number. Then in S240, the controller 130 adds the number of the lines in the unit area 81 to the one-page completed line number. Then in S250, the controller 130 judges whether the one-pass completed line number is equal to the above-described predetermined number of the nozzles (i.e., the number of the lines contained in the range B) or not. Where the controller 130 has judged that the one-pass completed line number is not equal to the above-described predetermined number of the nozzles (S250: No), the controller 130 executes the processing in S40 again.

Where the controller 130 has judged that the one-pass completed line number is equal to the above-described predetermined number of the nozzles (S250: Yes), the controller 130 in S260 judges whether a ratio of the color dots to all the dots constituting the recording data corresponding to the predetermined number of the lines of the nozzles (i.e., the lines contained in the range B) is less than a second threshold value or not. Here, the second threshold value is a value for judging whether the number of the color dots in the recording data constituting the lines corresponding to the range B is large or small. In the present embodiment, a unit of the second threshold value is a percentage (%) like the first threshold value, and specifically, the second threshold value is also set at 20(%). It is noted that the second threshold value is not limited to the unit and the value set in the present embodiment. It is noted that the controller 130 can be considered to include a second judging section configured to execute a processing in S260, for example.

Where the controller 130 has judged that the ratio of the color dots in the recording data corresponding to the lines contained in the range B is less than the second threshold value (S260: Yes), the controller 130 in S270 determines the processing in which the image recording is performed on the recording sheet 19 on the basis of the recording data corresponding to the lines contained in the range B, as the above-described two-way recording processing. On the other hand, where the controller 130 has judged that the ratio of the color dots in the recording data corresponding to the lines contained in the range B is equal to or greater than the second threshold value (S260: No), the controller 130 in S280 determines the processing in which the image recording is performed on the recording sheet 19 on the basis of the recording data corresponding to the lines contained in the range B, as the above-described one-way recording processing.

Then in S290, the controller 130 adds one to the pass number N. Then in S300, the controller 130 controls the recording head 65 to perform the image recording on the recording sheet 19 on the basis of recording data from the pass first line set in S20 to the one-page completed line number at this point in time as the N-th recording data. When performing the one-way recording processing, the controller 130 moves the carriage 67 to a position on a left side of an image recording area on the recording sheet 19 and then controls the recording head 65 to eject the ink droplets from the nozzles on the basis of the recording data while moving the carriage 67 in the rightward direction. On the other hand, when performing the two-way recording processing, the controller 130 controls the recording head 65 to eject the ink droplets from the nozzles on the basis of the recording data while moving the carriage 67 from the current position in the rightward direction or the leftward direction. It is noted that the controller 130 can be considered to include a first recording executing section configured to execute the processings in S200, S210, S270, S280, and S300 and a second recording executing section configured to execute the processings in S270, S280, and S300, for example.

Then in S310, the controller 130 changes the division flag to "OFF". The controller 130 then executes the above-described processing in S320.

Figure 6:
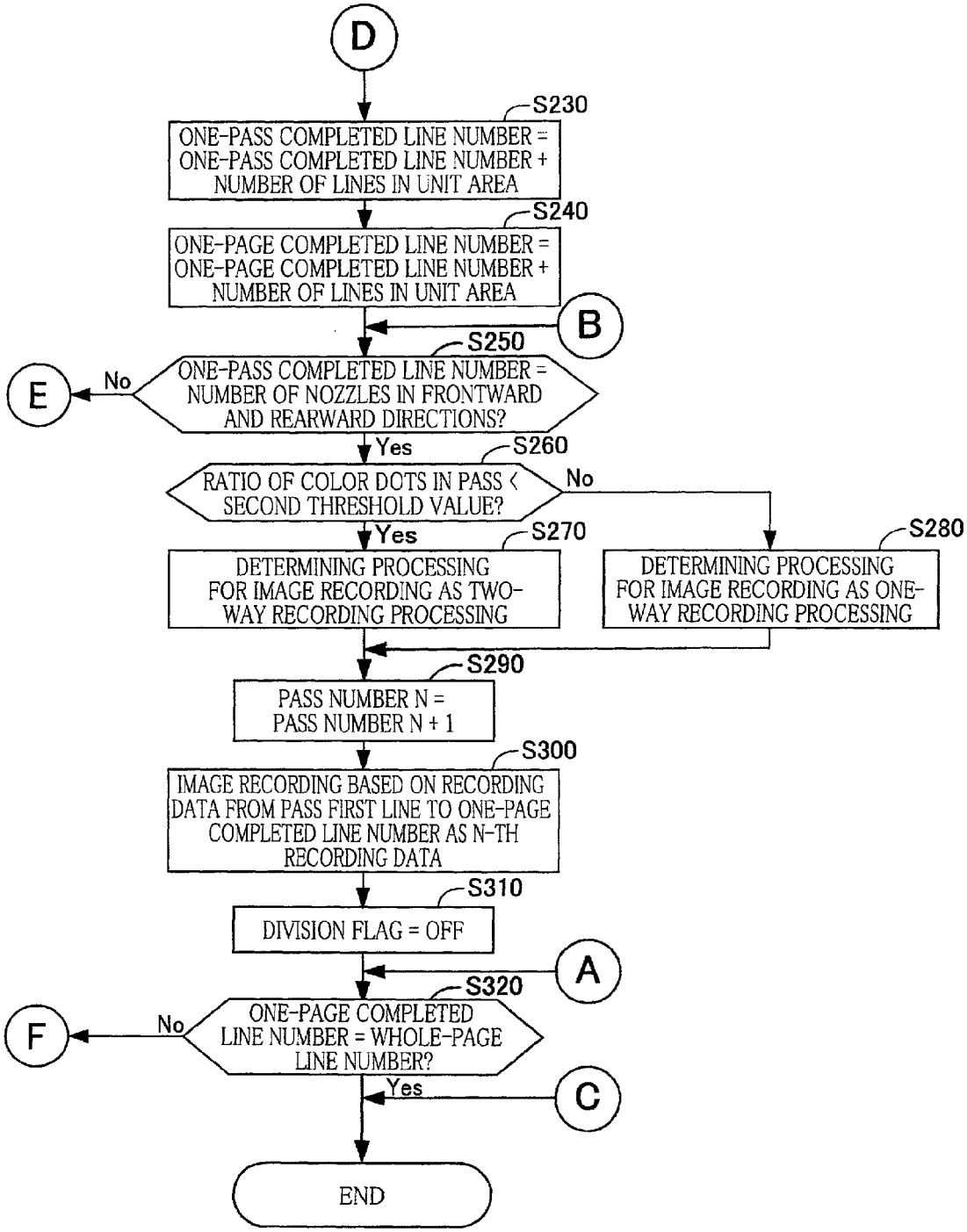
FIG. 6 is a flow-chart for explaining the recording control.

There will be briefly explained a processing for a case where the image recording is performed on the recording sheet 19 on the basis of recording data shown in FIG. 9A in accordance with the flow-charts in FIGS. 5 and 6 explained above.

The unit area 81A as a first judgment object is judged in S140 to be the few-color area after the processings S10-S130 (S140: Yes). Since the many-color area number is "0" (S150: Yes), the few-color area number is changed from "0" to "1" in S160.

Then, the processings in S40 and subsequent steps are executed again after the execution of the processing in S230-S250. The judgment object at this time is the unit area 81B. The unit area 81B is judged in S140 to be the few-color area (S140: Yes). Since the many-color area number is "0" (S150: Yes), the few-color area number is changed from "1" to "2" again in S160.

Then, the processings in S40 and subsequent steps are executed again after the execution of the processing in S230-S250. The judgment object at this time is the unit area 81C. For the unit area 81C, the same processings as executed for the unit area 81B are executed, and the few-color area number is changed from "2" to "3" in S160.

The next judgment object in S40 is the unit area 81D. The unit area 81D is judged in S140 to be the many-color area (S140: No). Since the few-color area number is "3" (S170: No), the processings in S190 and subsequent steps are executed. That is, the pass number N is set at "1" in S190. Then, the recording processing is determined as the two-way recording processing in S200, and in S210, the ink ejection is performed on the recording sheet 19 on the basis of data of the unit areas 81A-81C in FIG. 9A (i.e., the first recording data), as first pass data. In S220, the division flag is set to "ON". Then, the processings in S20 and subsequent steps are executed after the execution of the processing in S320. As a result, the few-color area number is reset at "0" in S30.

The next judgment object in S40 is the unit area 81D. Thereafter, where the unit areas 81D-81G are the judgment object, the processings in S140-S220 are not executed because the division flag is "ON" (S130: Yes). Then in S250 in a case where the judgment object is the unit area 81G, it is judged that the one-pass completed line number and the above-described predetermined number of the nozzles (the number of the lines contained in the range B) are equal to each other (S250: Yes). As a result, the processings in S260 and subsequent steps are executed, and in S300, the image recording is performed on the recording sheet 19 on the basis of the data of the unit areas 81D-81G in FIG. 9A (i.e., the second recording data) as second pass data. In view of the above, in the present embodiment, the line number of the second recording data is the above-described predetermined number of the nozzles.

That is, in the example shown in FIG. 9A, where the carriage 67 is located on a right side of the recording sheet 19 before the recording, the two-way recording processing is initially performed in which the ink is ejected onto the unit areas 81A-81C while the carriage 67 is moved in the leftward direction. Then, the ink is ejected onto the unit areas 81D-81G while the carriage 67 is moved in the rightward direction by the one-way recording processing. That is, in the present embodiment, the ink is ejected onto seven unit areas in the one reciprocation of the carriage 67. Here, there is explained a case where the conventional technique is used in the example shown in FIG. 9A. In the technique, the one-way recording processing is performed where the range B contains the unit area judged to be the many-color area. In this case, the unit areas 81A-81D contained in the range B includes the unit area 81D judged to be the many-color area. Thus, in this case, the one-way recording processing is initially performed in which the carriage 67 is moved to a position located on a left side of the recording sheet 19, and then the ink is ejected onto the unit areas 81A-81D while the carriage 67 is moved in the rightward direction. The unit areas contained in the range B in the next movement of the carriage 67 are the unit areas 81E-81H. Since this range B contains the unit areas 81E, 81G, 81H judged to be the many-color area, the one-way recording processing is to be performed. Since the carriage 67 is located on a right side of the recording sheet 19 after the ink ejection onto the unit areas 81A-81D, the one-way recording processing for the unit areas 81E-81H is performed, like the one-way recording processing for the unit areas 81A-81D, such that the carriage 67 is moved to the position located on a left side of the recording sheet 19, and then the ink ejection is performed onto the unit areas 81E-81H while the carriage 67 is moved in the rightward direction. That is, where the conventional technique is performed in the example shown in FIG. 9A, the ink can be ejected onto only eight unit areas in the two reciprocations of the carriage 67 (that is, the ink can be ejected onto only four unit areas per one reciprocation of the carriage 67). Accordingly, the MFD 1 as the present embodiment can perform the recording on more unit areas per one reciprocation of the carriage 67 than the conventional technique, making it possible to speedily record the image on the recording sheet 19.

Figure 9B:
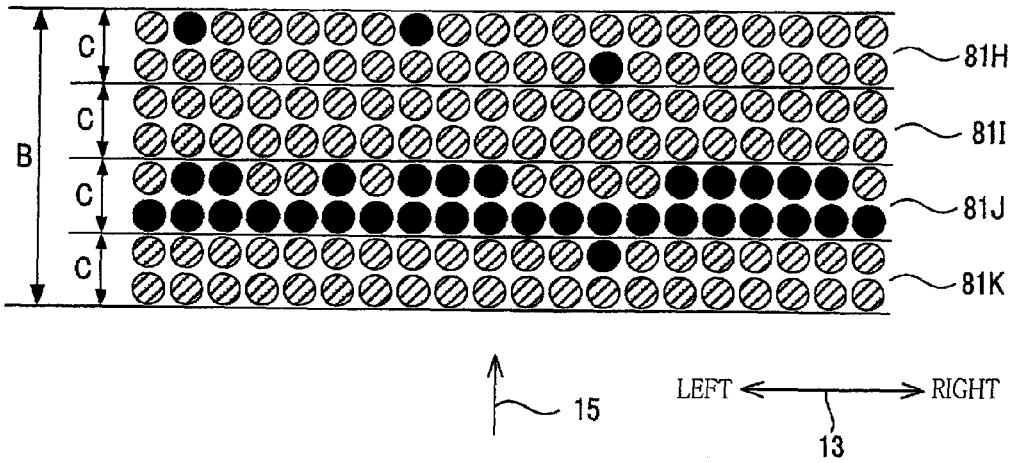

There will be briefly explained a processing for a case where the image recording is performed on the recording sheet 19 on the basis of recording data shown in FIG. 9B in accordance with the flow-charts in FIGS. 5 and 6.

The unit area 81H as a first judgment object is judged in S140 to be the many-color area after the execution of the processings in S10-S130 (S140: No). Since the few-color area number is "0" (S170: Yes), the many-color area number is changed from "0" to "1" in S180. Then, the processings in S40 and subsequent steps are executed again after the execution of the processing in S230-S250. The judgment object at this time is the unit area 81I.

The unit area 81I is judged in S140 to be the many-color area (S140: No). Since the few-color area number is "0" (S170: Yes), the many-color area number is changed from "1" to "2" in S180. Then, the processings in S40 and subsequent steps are executed again after the execution of the processing in S230-S250. The judgment object at this time is the unit area 81J.

The unit areas 81J is judged in S140 to be the few-color area (S140: Yes). Since the many-color area number is "2" (S150: No), the processing in S230 is executed. Then, the processings in S40 and subsequent steps are executed again after the execution of the processing in S230-S250. The judgment object at this time is the unit area 81K.

Where the unit area 81K is the judgment object, the controller 130 executes the processings to S240 like in the case of the unit area 81I. Then in S250, it is judged that the one-pass completed line number and the above-described predetermined number of the nozzles (the number of the lines contained in the range B) are equal to each other (S250: Yes). As a result, the processings in S260 and subsequent steps are executed, and in S300, the image recording is performed on the recording sheet 19 on the basis of the data of the unit areas 81H-81K in FIG. 9B as first pass data.

In view of the above, in the recording control in the present embodiment, the first recording data corresponding to the unit areas from the unit area 81A as a first unit area of the recording data to the unit area 81C located in front of the unit area 81D having a relatively large number of color dots is initially separated from the other recording data. Then, the image recording is performed on the basis of the first recording data (i.e., the recording data corresponding to the unit areas 81A-81C). Then, the image recording is performed on the basis of the second recording data of the unit areas 81D-81G constituted by the predetermined number of the lines, with the unit area 81D having a relatively large number of color dots being as a first unit area.

It is noted that, in the present embodiment, the recording data is distinguished on the basis of the black dots and the color dots different from the black dots. Further, the judgments in S140 and S260 are executed on the basis of the distinguishment. However, where the recording data is distinguished on the basis the number of the types (colors) of the ink required for the ejection in the image recording, the recording data may not be distinguished on the basis of the black dots and the color dots different from the black dots. For example, the recording data may be distinguished on the basis of dots each required for the ejection of only one of the black ink, the cyan ink, the magenta ink, the yellow ink in the image recording and dots each required for the ejection of at least two types (colors) of the inks among the four types of the inks in the image recording.

ADVANTAGEOUS EFFECTS OF EMBODIMENT

In the present embodiment, the first recording data based on which the image recording is performed on the recording sheet 19 by the two-way recording processing in S200 and S210 is the data in which the ratio of the dots required for the ejection of the ink droplets of the multiple colors onto the recording sheet 19 is relatively low. That is, the first recording data is the data having little effect of the color difference of the recorded image due to the ink ejection order. In view of the above, in the present embodiment, the recording data having little effect of the color difference of the recorded image due to the ink ejection order is the data based on which the image recording is performed using the two-way recording processing that requires less time for the image recording than the one-way recording processing. As a result, it is possible to increase the speed of the image recording on the recording sheet 19.

Meanwhile, in the present embodiment, the data having a relatively high ratio of the dots required for the ejection of the ink droplets of the multiple colors onto the recording sheet 19 is the data based on which the image recording is performed on the recording sheet 19 using the one-way recording processing in S280 and S300. In other words, where the image recording is performed on the recording sheet 19 on the basis of the recording data having great effect of the color difference of the recorded image due to the ink ejection order, the moving direction of the carriage 67 is set as or fixed to the rightward direction. As a result, it is possible to prevent an occurrence of the color difference of the recorded image on the recording sheet 19 due to a difference of the ink ejection order.

Further, in the present embodiment, the line number of the second recording data is the above-described predetermined number of the nozzles. Here, the predetermined number is the maximum line number that is the number of the maximum lines on which the recording can be performed on the recording sheet 19 during a single movement of the carriage 67 in the rightward direction or the leftward direction. That is, since the line number of the second recording data is the predetermined number, it is possible to speedily perform the image recording on the recording sheet 19.

As described above, when the image recording is performed on the basis of the recording data having great effect of the color difference of the recorded image due to the ink ejection order, the moving direction of the carriage 67 is the rightward direction. Thus, where the current moving direction of the carriage 67 is the rightward direction, effects to be achieved (i.e., prevention of the occurrence of the color difference of the recorded image on the recording sheet 19) are not changed regardless of whether the processing in S140 is executed or not. Meanwhile, where the processing in S140 is executed in the case where the current moving direction of the carriage 67 is the rightward direction, an increase in the number of the processing to be executed reduces the speed of the image recording on the recording sheet 19.

In order to solve this problem, in the present embodiment, the processing in S140 is executed on the condition that the current moving direction of the carriage 67 is not the rightward direction, that is, the current moving direction of the carriage 67 is the leftward direction. In this case, the processings S190-S220 or S260-S300 are executed on the basis of the result of the judgment in S140. As a result, it is possible to prevent the carriage 67 from moving in the leftward direction when the image recording is performed on the basis of the recording data having great effect of the color difference of the recorded image due to the ink ejection order. As a result, it is possible to prevent the occurrence of the color difference of the recorded image on the recording sheet 19 due to the ink ejection order.

As in the present embodiment, where the processing in S140 is not executed in the case where the condition in S120 is satisfied (S120: Yes), the carriage 67 is moved once or twice for the image recording on the recording sheet 19 on the basis of the remaining recording data. On the other hand, if the processing in S140 is executed in the case where the condition in S120 is satisfied (S120: Yes), the carriage 67 is moved twice or three times for the image recording on the recording sheet 19 on the basis of the remaining recording data. That is, a length of time required for the image recording on the recording sheet 19 where the processing in S140 is not executed is shorter than a length of time required for the image recording on the recording sheet 19 where the processing in S140 is executed, because the number of the movement of the carriage 67 is reduced and the processing in S140 is not executed.

In the present embodiment, where the condition of the processing in S120 is satisfied (S120: Yes), the processing in S140 is not executed. As a result, as described above, it is possible to shorten the time required for the image recording on the recording sheet 19.

<First Modification>

In the above-described embodiment, in the judging processings (e.g., S90, S140, and S260) in FIGS. 5 and 6, the controller 130 judges the ratio of the color dots in all the dots in the unit area 81. However, in the judging processings in FIGS. 5 and 6, the controller 130 may judge the ratio of the color dots in all the dots in the unit area 81 on the basis of part of the recording data (i.e., data obtained by reducing some dots from the dots of the recording data). For example, a configuration of the dots of the recording data is a configuration shown in FIGS. 9A and 9B, the controller 130 may execute the judgments on the basis of only ten dots each enclosed by a broken-line circle among forty dots constituting the unit area 81A. In this case, the ratio of the color dots in the unit area 81A is 10(%) (=(1/10)×100). This value is smaller than 20(%) of the first threshold value. Thus, the controller 130 judges that the unit area 81A is the few-color area. It is needless to mention that the controller 130 may execute the judgments for the unit area 81B and subsequent areas on the basis of part of their respective recording data.

In this first modification, the number of dots in recording data as a judgment object is reduced, thereby shortening a time required for the judging processings.

<Second Modification>

Figure 7:
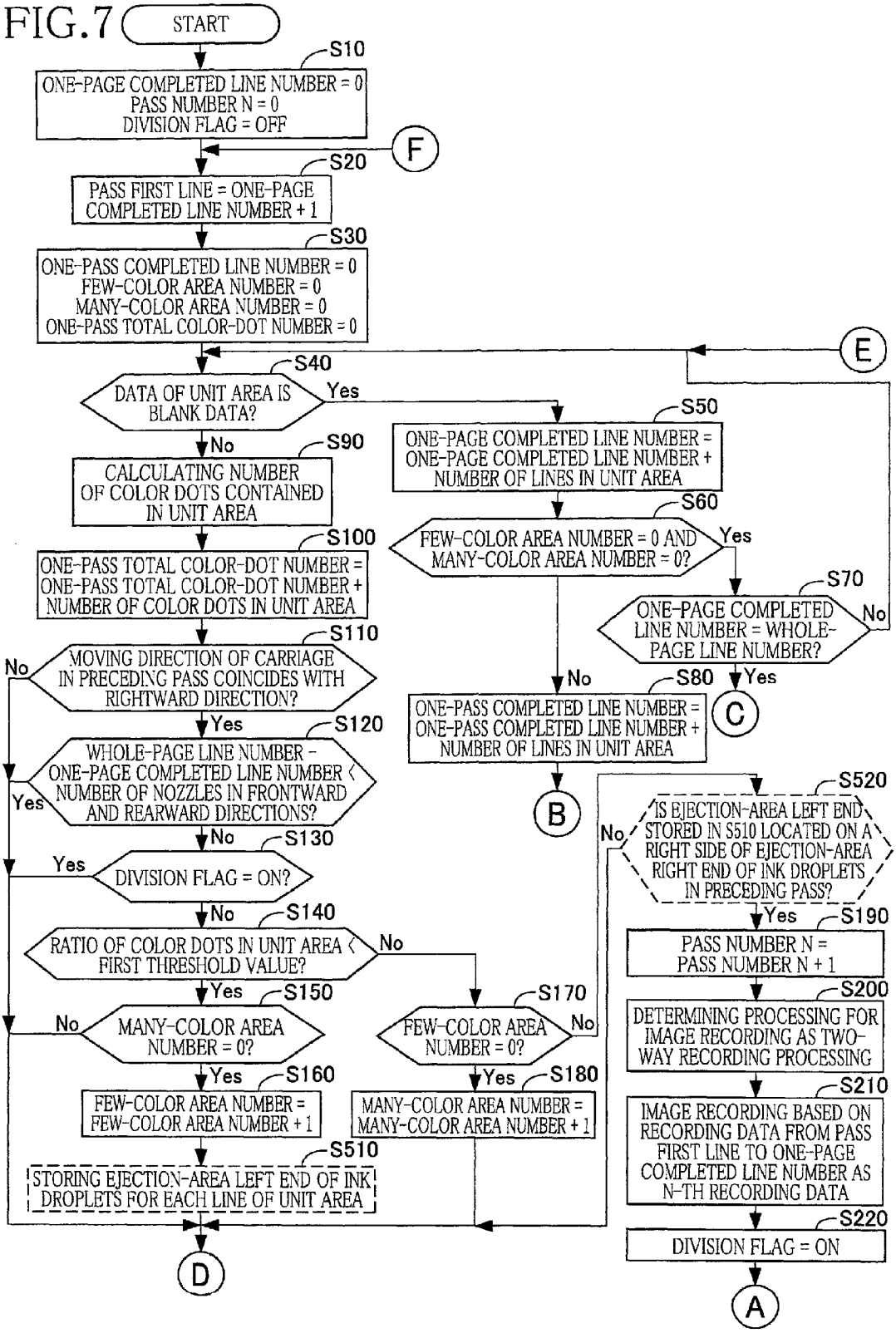
FIG. 7 is a flow-chart for explaining a recording control in a second modification.
Figure 10:
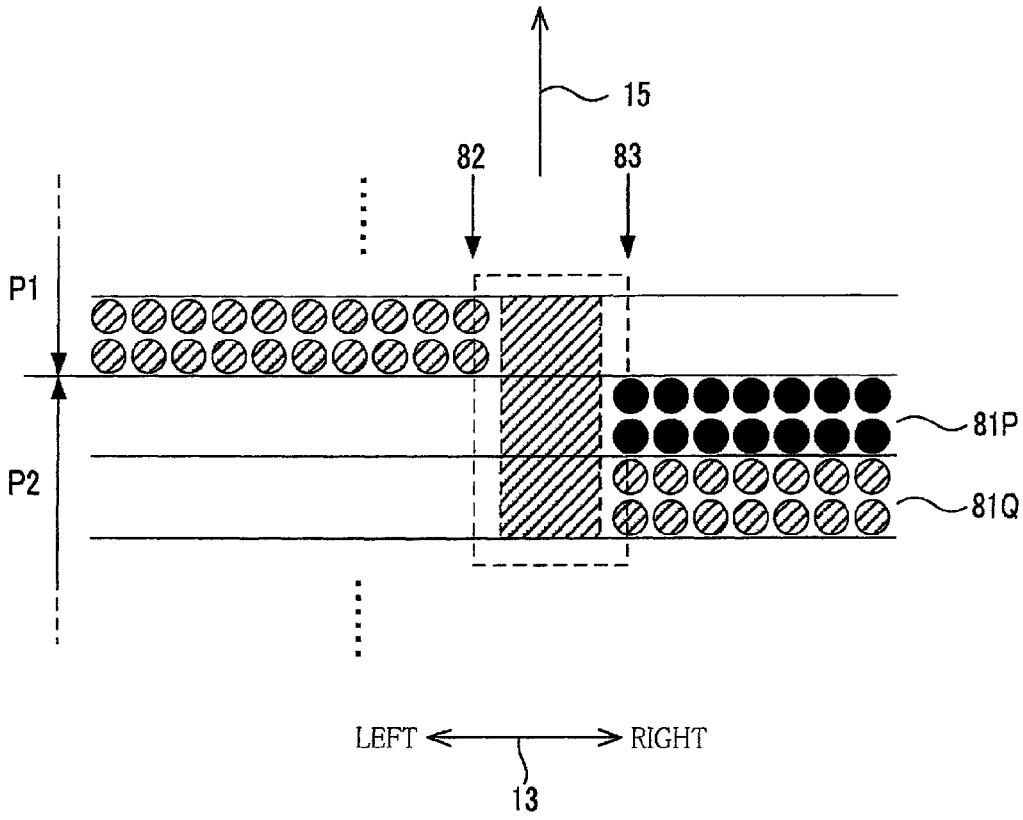
FIG. 10 is a schematic view showing dots to be recorded on the recording sheet 19, for explaining the processing of the controller 130 in the second modification.

As shown in FIG. 10, the processings in S190-S220 may not be executed where an ejection-area right end 82 of an area P1 onto which the ink droplets are ejected in the preceding pass is located on a left side of an ejection-area left end 83 of an area P2 onto which the ink droplets are ejected in the current pass. In this case, the recording control is executed according to a flow-chart in FIG. 7, for example. Here, FIG. 7 is a flow-chart in which processings in S510 and S520 indicated by broken lines are added to the flow-chart in FIG. 5. There will be next explained processings added in FIG. 7 in a case where the recording data has a configuration in FIG. 10.

The controller 130 stores the ejection-area right end 82 of the ink droplets in a pass corresponding to the area P1, into the RAM 133 when the ink droplets are ejected in S300 in FIG. 6, for example. Then, the processings S20 (see FIG. 5) and subsequent steps are executed after the execution of the processing in S320. The judgment object at this time is the unit area 81P. The unit area 81D is judged in S140 to be the few-color area (S140: Yes). At this time, the controller 130 in S510 stores into the RAM 133 the ejection-area left end 83 of the ink droplets for each line of the unit area 81P.

Then, where the judgment object is the unit area 81Q, the unit area 81Q is judged in S140 to be the many-color area (S140: No). Since the few-color area number is "1" at this time (S170: No), a processing in S520 is executed before the processings in S190 and subsequent steps. In S520, the controller 130 compares the ejection-area right end 82 stored in the preceding pass with the ejection-area left end 83 stored in S510 in the current pass. Where the ejection-area left end 83 is located on a right side of the ejection-area right end 82, the processing in S230 is executed without executing the processings in S190-S220.

Where the processings in S190-S220 are executed in the case where the recording data has the configuration in FIG. 10, it is required that the recording portion 24 moves in the rightward direction while performing the image recording on the unit area 81P and then moves in the leftward direction for the image recording on the unit area 81Q having a relatively large number of color dots by the one-way recording processing. On the other hand, where the processings in S190 and subsequent steps are not executed in the case where the recording data has the configuration in FIG. 10, the recording portion 24 only needs to move in the rightward direction in S300 to perform the image recording on the unit areas 81P, 81Q. Thus, the processing in FIG. 7 can shorten the time required for the image recording.

<Third Modification>

Figure 12:
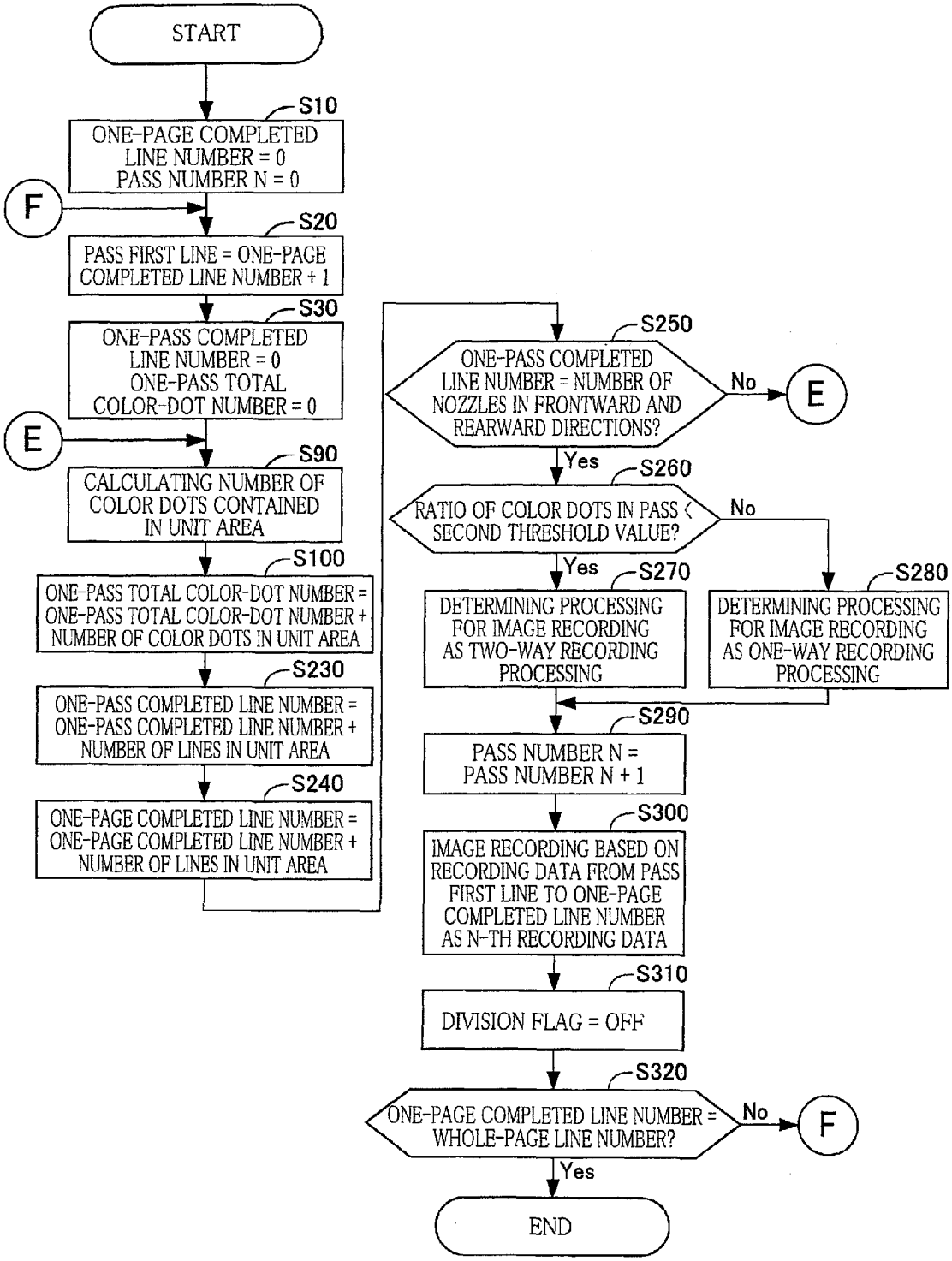
FIG. 12 is a flow-chart for explaining the second processing.

The controller 130 may execute a processing for calculating a first time required for the image recording on the recording sheet 19 in a first processing shown in the flow-charts in FIGS. 5 and 6. Here, in the first processing, the processings in S140, S210, S220, S270, S280, and S300 corresponding to the first judging section and the first recording executing section are executed. It is noted that the controller 130 can be considered to include a first calculating section configured to calculate the first time. Further, the controller 130 may execute a processing for calculating a second time required for the image recording on the recording sheet 19 in a second processing shown in a flow-chart shown in FIG. 12. Here, in the second processing, the processings in S140, S210, and S220 in FIGS. 5 and 6 corresponding to the first judging section and the first recording executing section are not executed, and the processings in S260, S270, S280, and S300 corresponding to the second judging section and the second recording executing section are executed. It is noted that the controller 130 can be considered to include a second calculating section configured to calculate the second time. The controller 130 may compare the calculated first time and second time with each other and execute one of the first processing and the second processing, which one has a shorter time required for the image recording on the recording sheet 19 than the other. It is noted that the controller 130 can be considered to include a selecting section configured to execute this processing.

Figure 11A:
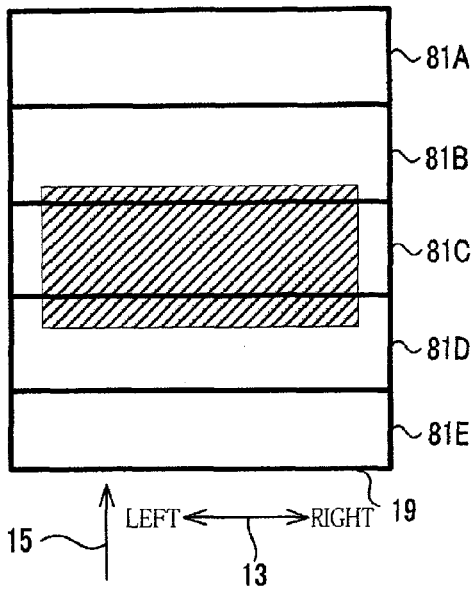
Figure 11B:
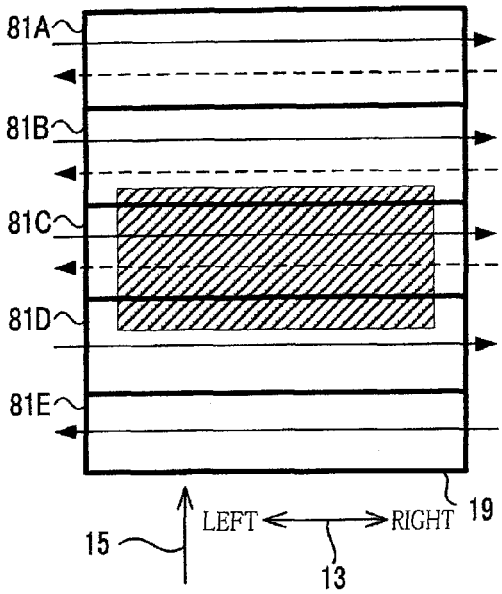
Figure 11C:
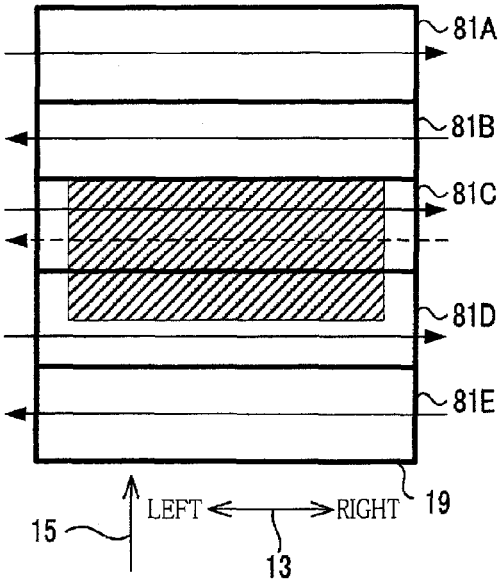

There will be next explained a case where an image shown in FIG. 11A is recorded in the recording sheet 19 in detail. Reference numerals 81A-81E in FIGS. 11A-11D represent the unit areas 81. Further, in the unit areas 81, hatch areas represent a color image, and areas not hatched represent an image constituted by only white and/or black. Further, each of solid-line arrow indicates a path in which the recording portion 24 moves while ejecting the ink droplets, and each of broken-line arrows indicates a path in which the recording portion 24 moves while ejecting the ink droplets. FIG. 11B shows that the image recording is performed according to the first processing, and FIG. 11C shows that the image recording is performed according to the second processing.

Figure 13:
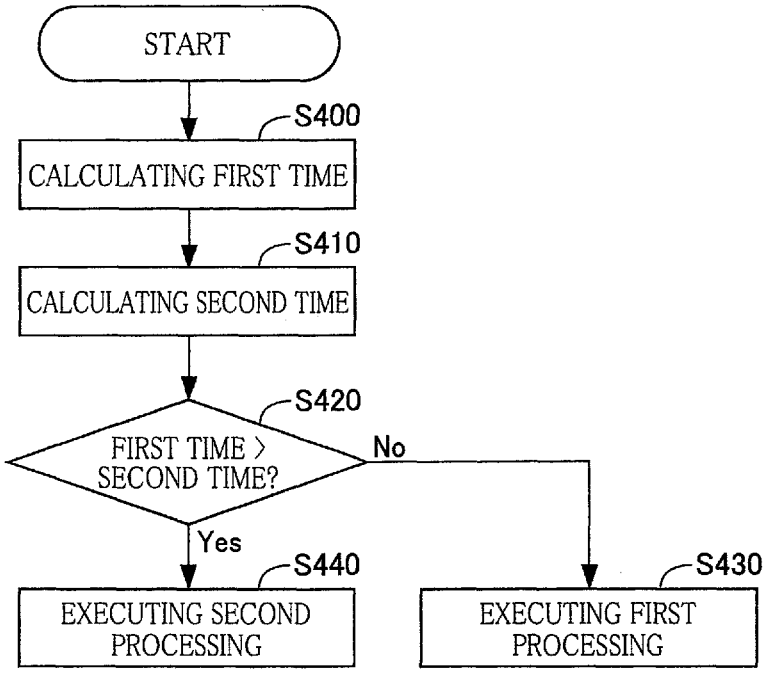
FIG. 13 is a flow-chart showing a processing for selecting the first processing or the second processing as a processing to be executed.

According to a flow-chart shown in FIG. 13, the controller 130 selects the first processing or the second processing as a processing to be executed, before the first processing or the second processing is actually started. In S400 and S410, the controller 130 calculates (i) a first time t1 required for recording the image shown in FIG. 11A on the recording sheet 19 by the first processing (see FIG. 11B) and (ii) a second time t2 required for recording the image shown in FIG. 11A on the recording sheet 19 by the second processing (see FIG. 11C). For example, the controller 130 stores, into the RAM 133 in advance, (i) a time required for the recording portion 24 to move in the rightward direction or the leftward direction while ejecting the ink droplets, i.e., a time required for the movement of the recording portion 24 by a distance of each solid-line arrow (300 (msec) in this example) and (ii) a time required for the recording portion 24 to move in the rightward direction or the leftward direction without ejecting the ink droplets, i.e., a time required for the movement of the recording portion 24 by a distance of each broken-line arrow (150 (msec) in this example). In this case, the controller 130 obtains 1950 (msec) (=300×5+150×3) as the first time t1, and 1650 (msec) (=300×5+150×1) as the second time t2. Then in S420, the controller 130 compares the obtained first time t1 and second time t2 with each other and executes a processing corresponding to a shorter one of the obtained first time t1 and second time t2. That is, where the first time t1 is shorter, the controller 130 in S430 executes the image recording in accordance with the flow-charts in FIGS. 5 and 6. Where the second time t2 is shorter, the controller 130 in S440 executes the image recording in accordance with the flow-chart in FIG. 12.

It is noted that, in this example, the controller 130 calculates the first time t1 and the second time t2 only based on the movement time of the recording portion 24 but may calculate the first time t1 and the second time t2 on the basis of a time required for the conveyance of the recording sheet 19 by the convey-roller pair 54 and the discharging-roller pair 55 in addition to the movement time of the recording portion 24.

In some recording data based on which the image recording is performed on the recording sheet 19, the time required for the image recording on the recording sheet 19 can be reduced by executing the second processing instead of the first processing. In the present embodiment, one of the first processing and the second processing is executed, which one is a processing in which the time required for the image recording on the recording sheet 19 is shorter than that of the other. As a result, it is possible to shorten the time required for the image recording on the recording sheet 19.

<Fourth Modification>

The operation panel 9 may be configured to selectively receive or accept one of (i) a speed priority mode in which a speed of the image recording on the recording sheet 19 has a higher priority than a quality of the image to be recorded on the recording sheet 19 and (ii) an image-quality priority mode in which the quality of the image to be recorded on the recording sheet 19 has a higher priority than the speed of the image recording on the recording sheet 19. In this case, the operation panel 9 is one example of a mode-setting accepting portion.

Figure 11D:
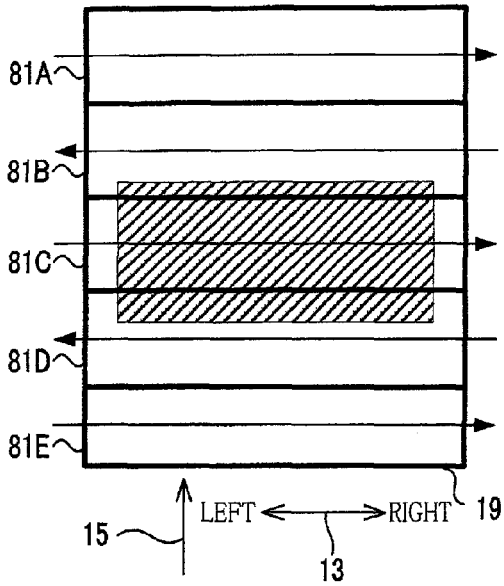

For example, the controller 130 displays, on the liquid crystal display portion 11 of the operation panel 9, a message for requesting to designate one of the speed priority mode and the image-quality priority mode and a message for requesting to choose one of operational buttons respectively corresponding to the two modes. Where the liquid crystal display portion 11 is a touch panel, the operational buttons respectively corresponding to the two modes are displayed on the liquid crystal display portion 11. In accordance with the messages, the user presses one of the operational buttons respectively corresponding to the speed priority mode and the image-quality priority mode. As a result, information about which mode has been designated is transmitted from the operation panel 9 to the controller 130.

Where the information transmitted from the operation panel 9 indicates that the speed priority mode has been designated, the controller 130 executes the two-way recording processing for all the unit areas 81 without executing the processings shown in FIGS. 5 and 6. A processing in this case is shown in FIG. 11D. On the other hand, where the information transmitted from the operation panel 9 indicates that the image-quality priority mode has been designated, the controller 130 executes the processings shown in FIGS. 5 and 6. That is, in the fourth modification, on a condition that the operation panel 9 has received the speed priority mode, the controller 130 controls the recording head 65 to record the image on the recording sheet 19 in accordance with only the two-way recording processing regardless of the colors indicated by the recording data.

In the present embodiment, in the case of the speed priority mode, the controller 130 controls the recording head 65 to record the image only by the two-way recording processing. As a result, it is possible to shorten the time required for the image recording on the recording sheet 19.

<Fifth Modification>

In the above-described embodiment, the one-pass total color-dot number is calculated in S90 and 5100 in FIG. 5, and the processing for the image recording is determined in S260-S280 depending on the one-pass total color-dot number. However, the one-pass total color-dot number may not be calculated. In this case, the processings in S90, S100, and S260-S280 are not executed. Further, in S300, the image recording is performed by the one-way recording processing.

What is claimed is:

1. A liquid ejection apparatus comprising:

a conveying mechanism configured to convey a recording medium in a first direction along a conveying path;

a carriage disposed above the conveying mechanism so as to be reciprocable in a second direction and a third direction, the second direction being a direction perpendicular to the first direction and along an image recording face of the recording medium, the third direction being a direction opposite to the second direction;

a recording head mounted on the carriage and having a nozzle face in which a plurality of nozzles are formed, the recording head being configured to eject liquid droplets of a single color or a plurality of colors from the plurality of nozzles toward the conveying path to record an image, the plurality of nozzles being divided into a plurality of nozzle groups in each of which a predetermined number of the plurality of nozzles are arranged in the first direction, the plurality of nozzle groups being arranged in the second direction, the recording head being configured to eject the liquid droplets of each of the plurality of colors from a corresponding one of the plurality of nozzle groups; and a controller configured to selectively execute (i) a one-way recording processing in which, while controlling the carriage to move in the second direction in a state in which the conveyance of the recording medium by the conveying mechanism is stopped, the controller controls the recording head to eject the liquid droplets from the plurality of nozzle groups on the basis of recording data to form at least one line, and, while controlling the carriage to move in the third direction in the state in which the conveyance of the recording medium is stopped, the controller controls the recording head not to eject the liquid droplets from the plurality of nozzle groups and (ii) a two-way recording processing in which, while controlling the carriage to move in the second direction and the third direction in the state in which the conveyance of the recording medium is stopped, the controller controls the recording head to eject the liquid droplets from the plurality of nozzle groups on the basis of the recording data to form at least one line, wherein the controller includes:

a first judging section configured to divide the recording data corresponding to a predetermined number of lines as a maximum number of lines recordable on the recording medium during a single movement of the carriage in one of the second direction and the third direction, into a plurality of sets of recording data respectively corresponding to a plurality of unit areas each having at least one line that is fewer than the predetermined number of lines, the first judging section being configured to judge whether a ratio of the number of dots each required for the ejection of the liquid droplets of at least two of the plurality of colors in each of the plurality of unit areas to the number of all dots in said each of the plurality of unit areas is equal to or greater than a first threshold value or not; and a first recording executing section configured to execute the two-way recording processing on the basis of first recording data included in the recording data corresponding to the predetermined number of lines, the first recording data being data based on which the recording head ejects the liquid droplets onto the recording medium on a downstream side, in the first direction, of a unit area for which the first judging section has judged that the ratio is equal to or greater than the first threshold value, the first recording executing section being configured to execute the one-way recording processing on the basis of second recording data that includes at least recording data corresponding to said unit area for which the first judging section has judged that the ratio is equal to or greater than the first threshold value and recording data based on which the recording head ejects the liquid droplets onto the recording medium on an upstream side of said unit area in the first direction, wherein the recording data corresponding to said unit area for which the first judging section has judged that the ratio is equal to or greater than the first threshold value and the recording data based on which the recording head ejects the liquid droplets onto the recording medium on an upstream side of said unit area in the first direction are included in the recording data corresponding to the predetermined number of lines.

2. The liquid ejection apparatus according to claim 1, wherein the first recording data does not include the recording data corresponding to said unit area for which the first judging section has judged that the ratio is equal to or greater than the first threshold value.

3. The liquid ejection apparatus according to claim 1, wherein the number of lines corresponding to the second recording data is the maximum number of the lines.

4. The liquid ejection apparatus according to claim 1, wherein the number of lines corresponding to the first recording data is less than the maximum number of the lines.

5. The liquid ejection apparatus according to claim 1, wherein the controller is configured to execute the control of the first judging section on condition that the moving direction of the carriage is the third direction.

6. The liquid ejection apparatus according to claim 1, wherein the controller is configured to execute the control of the first judging section on condition that the number of lines corresponding to remaining recording data based on which the image recording has not been performed on the recording medium is equal to or greater than the maximum number of the lines.

7. The liquid ejection apparatus according to claim 1, wherein the first judging section is configured to judge whether the ratio of the number of the dots each required for the ejection of the liquid droplets of at least two of the plurality of colors to the number of all the dots in each of the plurality of unit areas is equal to or greater than the first threshold value or not on the basis of recording data corresponding to dots obtained by reducing at least one of dot from all the dots in the unit area.

8. The liquid ejection apparatus according to claim 1, wherein the controller includes:

a second judging section configured to judge a ratio of the number of the dots each required for the ejection of the liquid droplets of at least two of the plurality of colors in the recording data corresponding to the predetermined number of lines to the number of all dots constituting the recording data is equal to or greater than a second threshold value in the recording data corresponding to the predetermined number of lines or not;

a second recording executing section configured to execute the one-way recording processing by controlling the recording head to eject the liquid droplets onto the recording medium on the basis of the recording data corresponding to the predetermined number of lines, where the second judging section has judged that the ratio is equal to or greater than the second threshold value, the second recording executing section being configured to execute the two-way recording processing by controlling the recording head to eject the liquid droplets onto the recording medium on the basis of the recording data corresponding to the predetermined number of lines, where the second judging section has judged that the ratio is less than the second threshold value;

a first calculating section configured to calculate a first time required for the image recording on the recording medium in a first processing in which the controls of the first judging section and the first recording executing section are executed;

a second calculating section configured to calculate a second time required for the image recording on the recording medium in a second processing in which the controls of the first judging section and the first recording executing section are not executed, and the controls of the second judging section and the second recording executing section are executed; and a selecting section configured to compare the first time and the second time with each other and to execute one of the first processing and the second processing, which one requires a shorter time for the image recording on the recording medium than the other.

9. The liquid ejection apparatus according to claim 1, further comprising a mode-setting accepting portion configured to selectively accept one of a speed priority mode in which a speed of the image recording on the recording medium has a higher priority than a quality of the image to be recorded on the recording medium and an image-quality priority mode in which the quality of the image to be recorded on the recording medium has a higher priority than the speed of the image recording on the recording medium, wherein the controller is configured to control the recording head to record the image on the recording medium by executing only the two-way recording processing on condition that the mode-setting accepting portion has received the speed priority mode.

* * * * *